US012638212B2

(12) United States Patent
Song et al.

(10) Patent No.: US 12,638,212 B2
(45) Date of Patent: May 26, 2026

(54) DRIVER MECHANISM FOR AIR DEFLECTION MECHANISM, AIR DEFLECTION MECHANISM, AND AIR CONDITIONER

(71) Applicant: GD MIDEA AIR-CONDITIONING EQUIPMENT CO., LTD., Foshan (CN)

(72) Inventors: Yingjie Song, Foshan (CN); Yuegan Xie, Foshan (CN); Qiankun Liu, Foshan (CN); Jianhua Lv, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 519 days.

(21) Appl. No.: 18/031,535

(22) PCT Filed: Sep. 26, 2021

(86) PCT No.: PCT/CN2021/120707
§ 371 (c)(1),
(2) Date: Apr. 12, 2023

(87) PCT Pub. No.: WO2022/089114
PCT Pub. Date: May 5, 2022

(65) Prior Publication Data

US 2023/0408137 A1 Dec. 21, 2023

(30) Foreign Application Priority Data

Oct. 30, 2020 (CN) ..... 202011193745.6
Oct. 30, 2020 (CN) ..... 202022484217.8

(51) Int. Cl.
*F24F 13/14* (2006.01)
*F24F 1/0011* (2019.01)

(52) U.S. Cl.
CPC ..... *F24F 13/14* (2013.01); *F24F 1/0011* (2013.01)

(58) Field of Classification Search
CPC ..... F24F 13/14; F24F 1/0011; F24F 13/10
(Continued)

(56) References Cited

U.S. PATENT DOCUMENTS 5,888,133 A * 3/1999 Mori ..... F24F 13/06 454/321
6,216,482 B1 * 4/2001 Xiao ..... F24F 1/027 62/262

FOREIGN PATENT DOCUMENTS

CN 202470348 U * 10/2012 ..... F24F 13/08
CN 102980282 A 3/2013
(Continued)

OTHER PUBLICATIONS

Chinese to English machine translation of CN 105757914 A.*
(Continued)

*Primary Examiner* — Michael G Hoang
*Assistant Examiner* — Elizabeth Ann Laughlin
(74) *Attorney, Agent, or Firm* — Anova Law Group, PLLC

(57) ABSTRACT

A driver mechanism includes a first connection rod movably in a housing of an air conditioner in an extending direction of an air outlet channel, a first driver assembly at the housing and connected to the first connection rod to drive the first connection rod to move, a second connection rod with a first end rotatably connected to an end of the first connection rod close to the air outlet and a second end extending towards an air outlet at the housing and in communication with the air outlet channel, and a second driver assembly at the housing and connected to the second connection rod to drive the second connection rod to rotate relative to the first connec-
(Continued)

tion rod. The second driver assembly is slidable relative to the second connection rod. The second end of the second connection rod is fixedly connected to a deflector of the air conditioner.

20 Claims, 22 Drawing Sheets

(58) Field of Classification Search
USPC ..... 454/313
See application file for complete search history.

(56) References Cited

FOREIGN PATENT DOCUMENTS

| | | | | | |
|---|---|---|---|---|---|
| CN | 105757914 | A | * | 7/2016 | ..... F24F 13/10 |
| CN | 205860349 | U | | 1/2017 | |
| CN | 106440296 | A | | 2/2017 | |
| CN | 106568124 | A | | 4/2017 | |
| CN | 106949554 | A | | 7/2017 | |
| CN | 107990424 | A | * | 5/2018 | ..... F24F 13/10 |
| CN | 107990528 | A | | 5/2018 | |
| CN | 108050599 | A | * | 5/2018 | ..... F24F 1/0011 |
| CN | 109520108 | A | | 3/2019 | |
| CN | 209926560 | U | | 1/2020 | |
| CN | 111140918 | A | | 5/2020 | |
| CN | 112197416 | A | | 1/2021 | |
| CN | 112212488 | A | | 1/2021 | |
| CN | 213273148 | U | | 5/2021 | |
| CN | 214949375 | U | | 11/2021 | |
| CN | 214949730 | U | | 11/2021 | |
| JP | 2002228249 | A | | 8/2002 | |
| JP | 4237238 | B1 | | 3/2009 | |
| WO | 2018066201 | A1 | | 4/2018 | |
| WO | WO-2018233261 | A1 | * | 12/2018 | ..... F24F 13/28 |

OTHER PUBLICATIONS

Chinese to English machine translation of CN 107990424 A.*
Chinese to English machine translation of CN202470348U.*
Chinese to English machine translation of CN106949554A.*
Japanese to English machine translation of JP4237238B1.*
Chinese to English machine translation of CN108050599A.*
Chinese to English machine translation of WO_2018233261_A1.*
The World Intellectual Property Organization (WIPO )International Search Report for PCT/CN2021/120707 Jan. 6, 2022 8 Pages (including translation).
The World Intellectual Property Organization (WIPO) Written Opinion for PCT/CN2021/120707 Jan. 6, 2022 10 pages (including English translation).
The European Patent Office (EPO) The extended Search report for EP Application No. 21884844.8 Feb. 1, 2024 9 Pages.
The China National Intellectual Property Administration (CNIPA) The First Office Action for Chinese Application 202011193745.6 Oct. 17, 2024 22 Pages (With Translation).

* cited by examiner

DRIVER MECHANISM FOR AIR DEFLECTION MECHANISM, AIR DEFLECTION MECHANISM, AND AIR CONDITIONER

CROSS-REFERENCE TO RELATED APPLICATIONS

This application is a National Stage Entry under 35 U.S.C. § 371 of International Application No. PCT/CN2021/120707, filed on Sep. 26, 2021, which is based on and claims priority to Chinese Patent Application Nos. 202022484217.8 and 202011193745.6, filed on Oct. 30, 2020, the entire contents of which are incorporated herein by reference.

FIELD

The present disclosure relates to the field of air treatment device technologies, and more particularly, to a driver mechanism for an air deflection mechanism, the air deflection mechanism, and an air conditioner.

BACKGROUND

In the related art, a deflector of an air deflection mechanism has a fixed rotation center when swinging, which does not allow for a variety of air deflecting functions and thus cannot meet use demands of a user.

SUMMARY

The present disclosure aims to solve at least one of the technical problems in the related art. To this end, the present disclosure provides a driver mechanism for an air deflection mechanism. The driver mechanism for the air deflection mechanism can alter a rotation center of a deflector, and adjust a swing angle of the deflector and a position of the deflector relative to a housing of an air conditioner, thereby providing different air deflecting functions.

The present disclosure further provides an air deflection mechanism. The air deflection mechanism includes the driver mechanism for the air deflection mechanism as described above.

The present disclosure further provides an air conditioner. The air conditioner includes the air deflection mechanism as described above.

The driver mechanism for the air deflection mechanism according to embodiments of the present disclosure is applied in an air conditioner including a housing. An air outlet is formed at the housing. An air outlet channel is formed in the housing and in communication with the air outlet. The driver mechanism including a first connection rod, a first driver assembly, a second connection rod movably, and a second driver assembly. The first connection rod is disposed in the housing in an extending direction of the air outlet channel. The first driver assembly is disposed on the housing. The first driver assembly is connected to the first connection rod to drive the first connection rod to move. The second connection rod has an end rotatably connected to an end of the first connection rod close to the air outlet and another end extending towards the air outlet. A deflector of the air conditioner is fixedly connected to the other end of the second connection rod facing away from the first connection rod to expose or close the air outlet. The second driver assembly is disposed on the housing. The second driver assembly is connected to the second connection rod to drive the second connection rod to rotate relative to the first connection rod. The second driver assembly is slidable relative to the second connection rod.

In the driver mechanism for the air deflection mechanism according to the embodiments of the present disclosure, the first connection rod and the second connection rod are provided. The first connection rod is movably disposed in the housing in the extending direction of the air outlet channel. The end of the second connection rod is rotatably connected to the end of the first connection rod adjacent to the air outlet, and the other end of the second connection rod extends towards the air outlet. The deflector is connected to the other end of the second connection rod facing away from the first connection rod. In addition, the first connection rod is driven by the first driver assembly to move, and the second connection rod is driven by the second driver assembly to rotate relative to the first connection rod. In this way, a rotation center of the deflector is variable, and the swing angle of the deflector and the position of the deflector relative to the housing of the air conditioner can be adjusted. Thus, different air deflecting functions can be provided. Therefore, the air conditioner has a variety of air blowing modes, which can satisfy different demands of a user.

In some embodiments of the present disclosure, a first rack is disposed on the first connection rod and extends in a length direction of the first connection rod. The first driver assembly includes a first drive motor disposed on the housing and a first gear connected to an output shaft of the first drive motor. The first gear is engaged with the first rack.

In some embodiments of the present disclosure, a slide groove is formed at the second connection rod and extends in a length direction of the second connection rod. The second driver assembly includes a second drive motor disposed on the housing, a second gear connected to an output shaft of the second drive motor, and a third connection rod movably disposed on the housing. A second rack is disposed on the third connection rod. The second rack extends in a length direction of the third connection rod and is engaged with the second gear. A slider is disposed on the third connection rod and slidably arranged in the slide groove.

In some embodiments of the present disclosure, the third connection rod extends along a straight line or an arc line.

In some embodiments of the present disclosure, the driver mechanism further includes a drive box disposed on the housing. The first connection rod, the first driver assembly, and the second driver assembly are disposed on the drive box. The first connection rod and the third connection rod are movably disposed in the drive box. The other end of the second connection rod extends out of the drive box. At least two first guide posts are disposed on the first connection rod and spaced apart from each other in a length direction of the first connection rod. A first guide groove is formed at the drive box and engaged with the at least two first guide posts. At least two second guide posts are disposed on the third connection rod and spaced apart from each other in the length direction of the third connection rod. A second guide groove is formed at the drive box and engaged with the at least two second guide posts.

In some embodiments of the present disclosure, a guide wheel is rotatably disposed in the drive box. An engagement groove being formed at a circumferential wall of the guide wheel and extends in a circumferential direction of the guide wheel. A guide channel is formed in the first connection rod and extends in the length direction of the first connection rod. The first connection rod is engaged into the engagement groove at each of two opposite side edges of the guide channel.

In some embodiments of the present disclosure, at least one of the first connection rod and the second connection rod extends along a straight line or an arc line.

In some embodiments of the present disclosure, the first connection rod has a length greater than or equal to 40 mm.

In some embodiments of the present disclosure, the second connection rod has a length greater than or equal to 40 mm.

In some embodiments of the present disclosure, the third connection rod has a length greater than or equal to 40 mm.

The air deflection mechanism according to embodiments of the present disclosure includes the driver mechanism for the air deflection mechanism as described above and a deflector fixedly connected to the other end of the second connection rod facing away from the first connection rod.

In the air deflection mechanism according to the embodiments of the present disclosure, the first connection rod and the second connection rod are provided. The first connection rod is movably disposed in the housing in the extending direction of the air outlet channel. The end of the second connection rod is rotatably connected to the end of the first connection rod adjacent to the air outlet, and the other end of the second connection rod extends towards the air outlet. The deflector is connected to the other end of the second connection rod facing away from the first connection rod. In addition, the first connection rod is driven by the first driver assembly to move, and the second connection rod is driven by the second driver assembly to rotate relative to the first connection rod. In this way, a rotation center of the deflector is variable, and the swing angle of the deflector and the position of the deflector relative to the housing of the air conditioner can be adjusted. Thus, different air deflecting functions can be provided. Therefore, the air conditioner has a variety of air blowing modes, which can satisfy different demands of a user.

In some embodiments of the present disclosure, two driver mechanisms are provided. Both ends of the deflector in a length direction thereof are connected to the two second connection rods, respectively.

In some embodiments of the present disclosure, a surface of the deflector facing towards the air outlet includes a first surface and a second surface in a width direction of the deflector. An edge of the first surface is connected to an edge of the second surface, and another edge of each of the first surface and the second surface extends towards a surface of the deflector facing away from the air outlet. A connection between the second connection rod and the deflector is coincident with a connecting line between the first surface and the second surface.

The air conditioner according to embodiments of the present disclosure includes the air deflection mechanism as described above.

In the air conditioner according to the embodiments of the present disclosure, the first connection rod and the second connection rod are provided. The first connection rod is movably disposed in the housing in the extending direction of the air outlet channel. The end of the second connection rod is rotatably connected to the end of the first connection rod adjacent to the air outlet, and the other end of the second connection rod extends towards the air outlet. The deflector is connected to the other end of the second connection rod facing away from the first connection rod. In addition, the first connection rod is driven by the first driver assembly to move, and the second connection rod is driven by the second driver assembly to rotate relative to the first connection rod. In this way, a rotation center of the deflector is variable, and the swing angle of the deflector and the position of the deflector relative to the housing of the air conditioner can be adjusted. Thus, different air deflecting functions can be provided. Therefore, the air conditioner has a variety of air blowing modes, which can satisfy different demands of a user.

Additional aspects and advantages of the present disclosure will be provided at least in part in the following description, or will become apparent at least in part from the following description, or can be learned from practicing of the present disclosure.

BRIEF DESCRIPTION OF THE DRAWINGS

The above and/or additional aspects and advantages of the present disclosure will become more apparent and more understandable from the following description of embodiments taken in conjunction with the accompanying drawings, in which.

Figure 1:
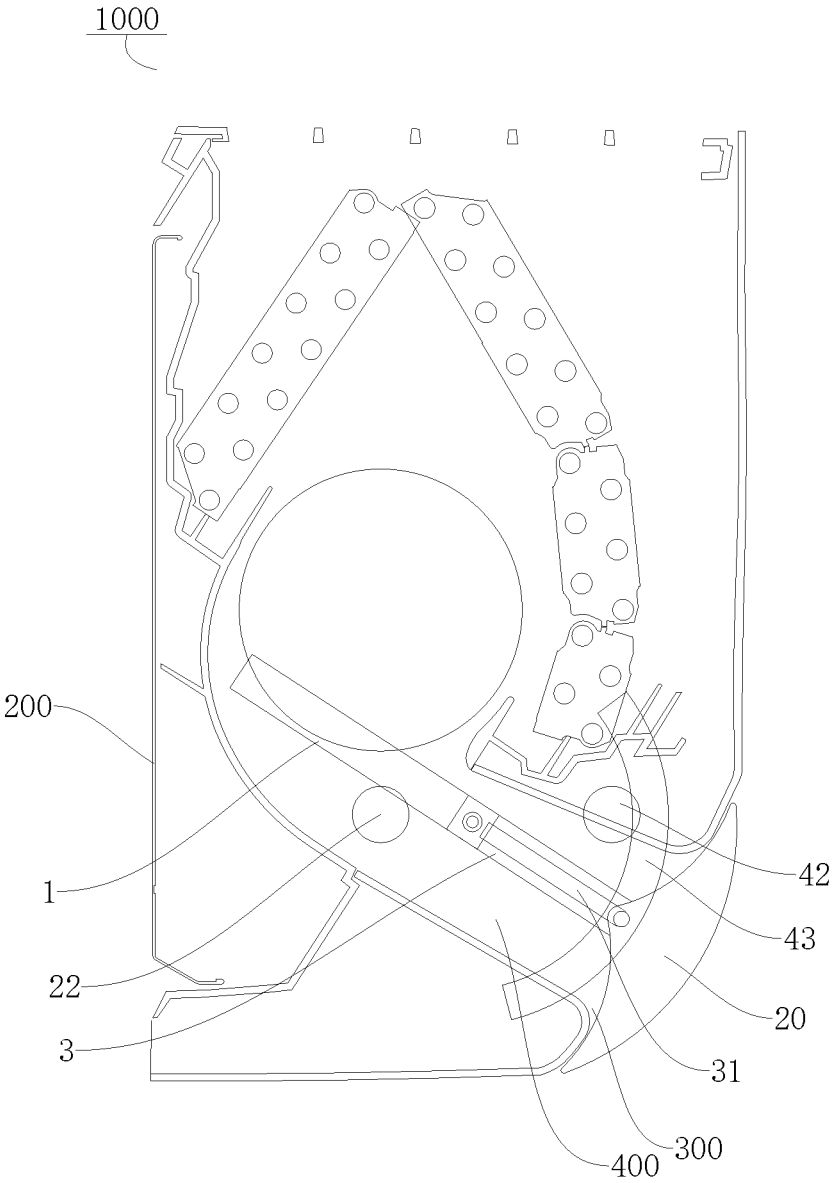
FIG. 1 is a cross-sectional view of an air conditioner according to an embodiment of the present disclosure with a deflector in a first state.

REFERENCE NUMERALS OF THE ACCOMPANYING DRAWINGS air conditioner 1000,
air deflection mechanism 100
driver mechanism 10,
first connection rod 1, first rack 11, first guide post 12, guide channel 13,
first driver assembly 2, first drive motor 21, first gear 22,
second connection rod 3, slide groove 31, positioning hole 32,
second driver assembly 4, second drive motor 41, second gear 42, third connection rod 43, second rack 431, second guide post 432, slider 433,
drive box 5, body 51, cover 52, first guide groove 53, second guide groove 54, guide wheel 55, engagement groove 551,
deflector 20, first surface 201, second surface 202, positioning post 203,
housing 200, air outlet 300, air outlet channel 400.

DETAILED DESCRIPTION OF THE EMBODIMENTS

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain, rather than limiting, the present disclosure.

A driver mechanism 10 for an air deflection mechanism 100, the air deflection mechanism 100, and an air conditioner 1000 according to embodiments of the present disclosure will be described below with reference to the accompanying drawings.

As illustrated in FIG. 1, the air conditioner 1000 includes a housing 200. An air outlet 300 is formed at the housing 200. An air outlet channel 400 is formed in the housing 200 and is in communication with the air outlet 300. The air deflection mechanism 100 includes a deflector 20 and the driver mechanism 10 configured to drive the deflector 20 to move. The driver mechanism 10 is disposed in the housing 200.

As illustrated in FIG. 1, the driver mechanism 10 for the air deflection mechanism 100 according to the embodiments of the present disclosure includes a first connection rod 1, a first driver assembly 2, a second connection rod 3, and a second driver assembly 4.

In some embodiments, the first connection rod 1 is movably disposed in the housing 200 in an extending direction of the air outlet channel 400. The first driver assembly 2 is disposed on the housing 200, and is connected to the first connection rod 1 to drive the first connection rod 1 to move. The second connection rod 3 has an end rotatably connected to an end of the first connection rod 1 adjacent to the air outlet 300 and another end extending towards the air outlet 300. The deflector 20 of the air conditioner 1000 is fixedly connected to the other end of the second connection rod 3 facing away from the first connection rod 1 to expose or close the air outlet 300. The second driver assembly 4 is disposed on the housing 200, and is connected to the second connection rod 3 to drive the second connection rod 3 to rotate relative to the first connection rod 1. The second driver assembly 4 is slidable relative to the second connection rod 3.

The disclosure "the deflector 20 of the air conditioner 1000 is fixedly connected to the other end of the second connection rod 3 facing away from the first connection rod 1" may mean that the deflector 20 and the second connection rod 3 are integrally formed, or that the deflector 20 is connected to or engaged with the second connection rod 3 by a fastener.

Figure 2:
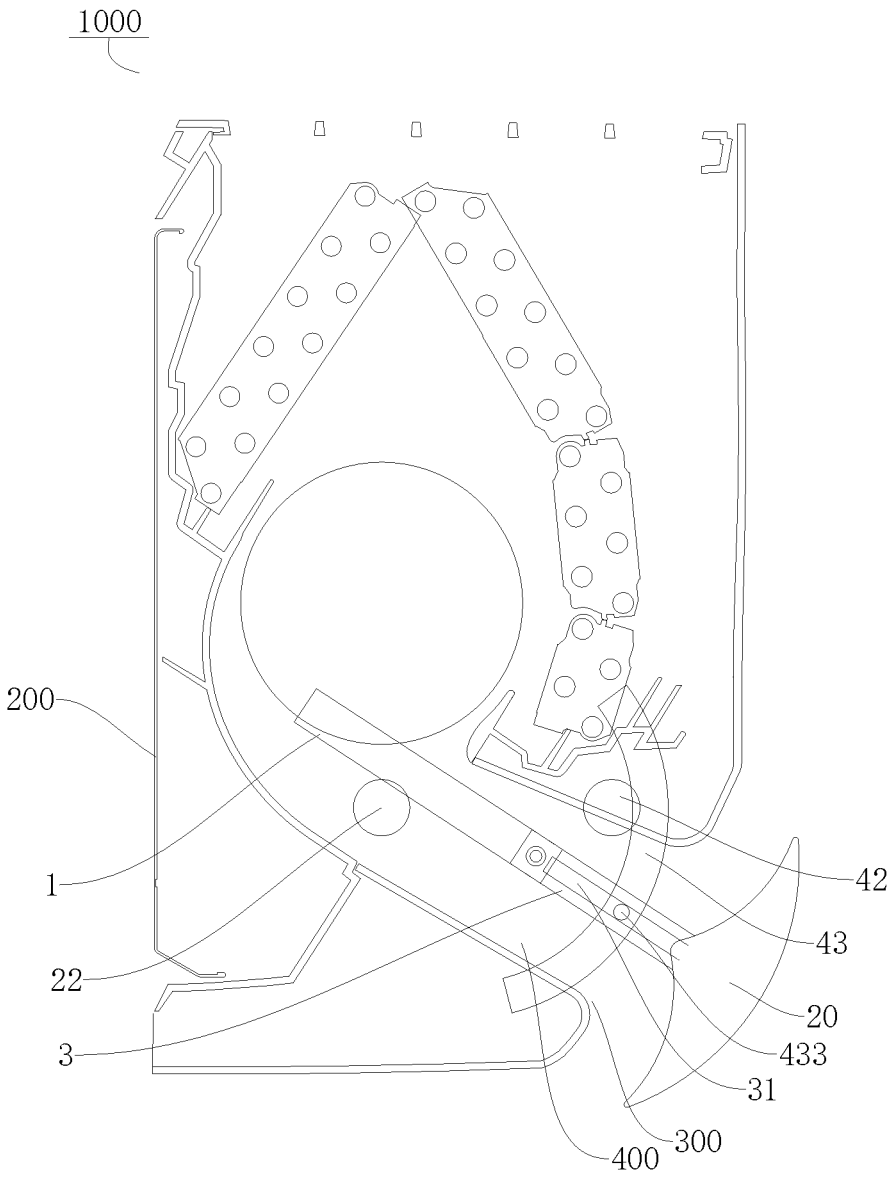
FIG. 2 is a cross-sectional view of an air conditioner according to an embodiment of the present disclosure with a deflector in a second state.
Figure 3:
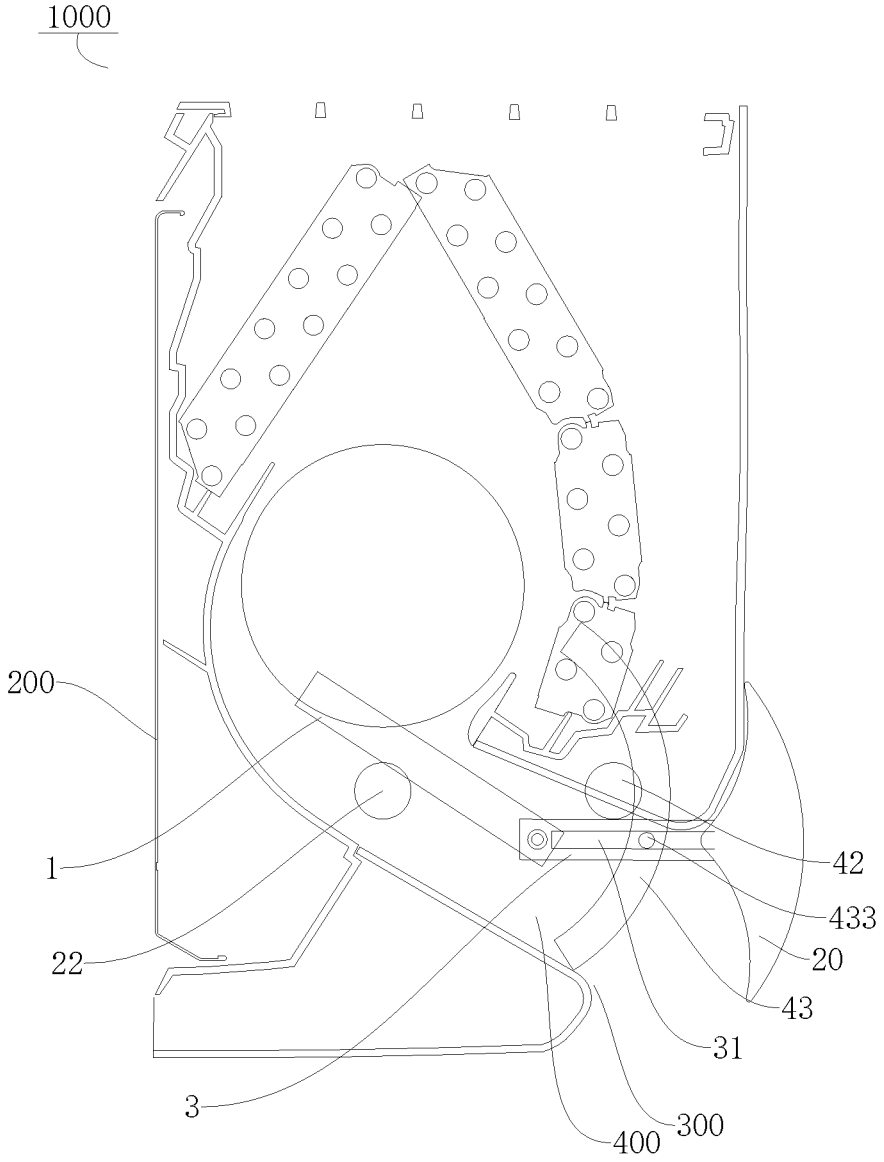
FIG. 3 is a cross-sectional view of an air conditioner according to an embodiment of the present disclosure with a deflector in a third state.
Figure 4:
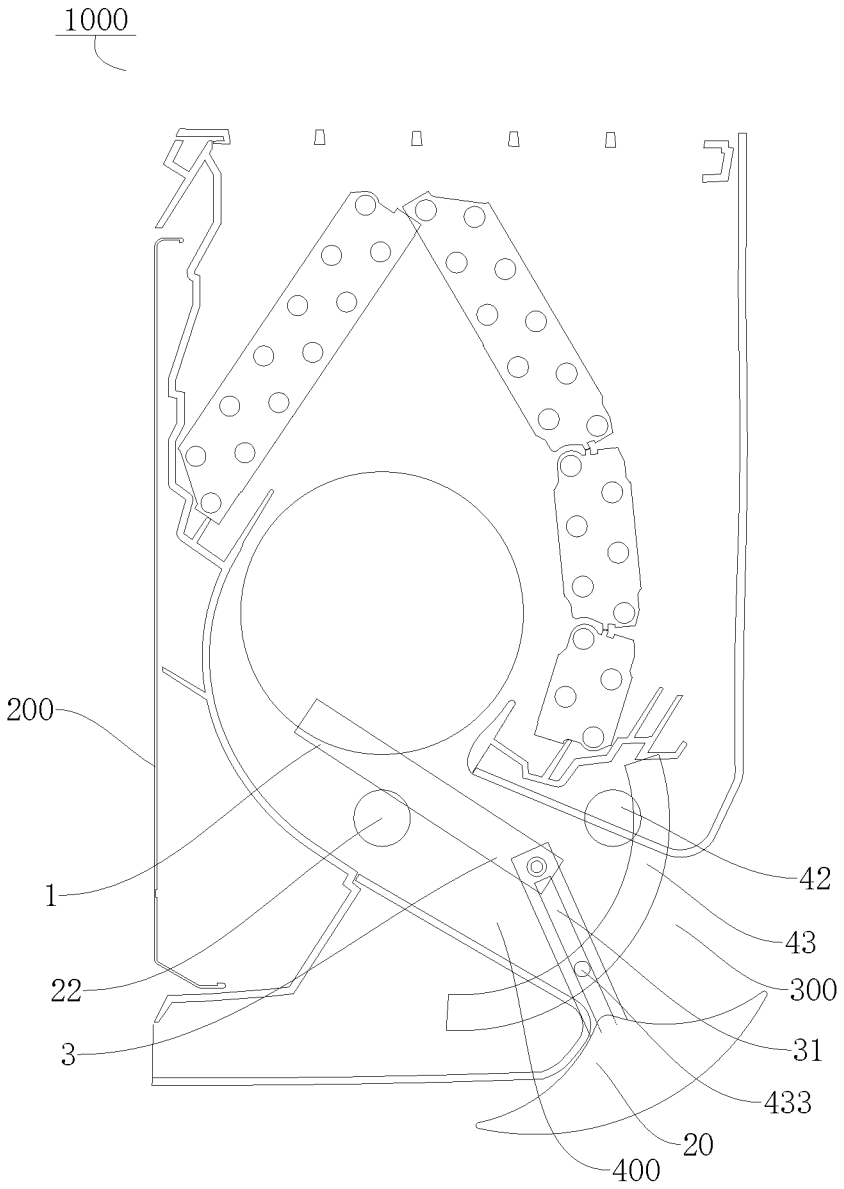
FIG. 4 is a cross-sectional view of an air conditioner according to an embodiment of the present disclosure with a deflector in a fourth state.

Reference can be made to FIG. 1 to FIG. 6. In an embodiment of the present disclosure, as illustrated in FIG. 1, when the first connection rod 1 and the second connection rod 3 are located in an initial position, the first connection rod 1 is located at a relatively inward position of the housing 200, the first connection rod 1 and the second connection rod 3 extend in the extending direction of the air outlet channel 400, and the air outlet 300 is closed by the deflector 20. As illustrated in FIG. 2, the first connection rod 1 is driven by the first driver assembly 2 to move towards the air outlet 300 by a predetermined distance. The second driver assembly 4 is in no operation. The second connection rod 3 moves towards the air outlet 300 by the predetermined distance together with the first connection rod 1, and slides relative to the second driver assembly 4. In this way, the air outlet 300 is exposed by deflector 20, and thus an airflow can flow through the air outlet 300 in both upward and downward directions of the air outlet 300. As a result, the air conditioner 1000 can realize both an upward air blowing and a downward air blowing. Such a two-way alternate airflow disturbing can realize better circulation and better cooling for a room. As illustrated in FIG. 3, on the basis of FIG. 2, the first driver assembly 2 is in no operation, and the second connection rod 3 is driven by the second driver assembly 4 to rotate upwards relative to the first connection rod 1. For example, when a distance between the deflector 20 and the housing 200 is smaller than or equal to 5 mm, the second driver assembly 4 stops its operation, which can allow the deflector 20 to be positioned at an upper limit position. As a result, the air conditioner 1000 can realize downward air blowing. In this way, a user can avoid the blown air and thus has a windless feeling, while rapid cooling can be achieved. As illustrated in FIG. 4, on the basis of FIG. 2 or FIG. 3, the first driver assembly 2 is in no operation, and the second connection rod 3 is driven by the second driver assembly 4 to rotate downwards relative to the first connection rod 1. For example, when the distance between the deflector 20 and the housing 200 is smaller than or equal to 5 mm, the second driver assembly 4 stops its operation, which can allow the deflector 20 to be positioned at a lower limit position. As a result, the air conditioner 1000 can realized upward air blowing. Thus, air direct-blowing of the air conditioner 1000 can be avoided.

Figure 5:
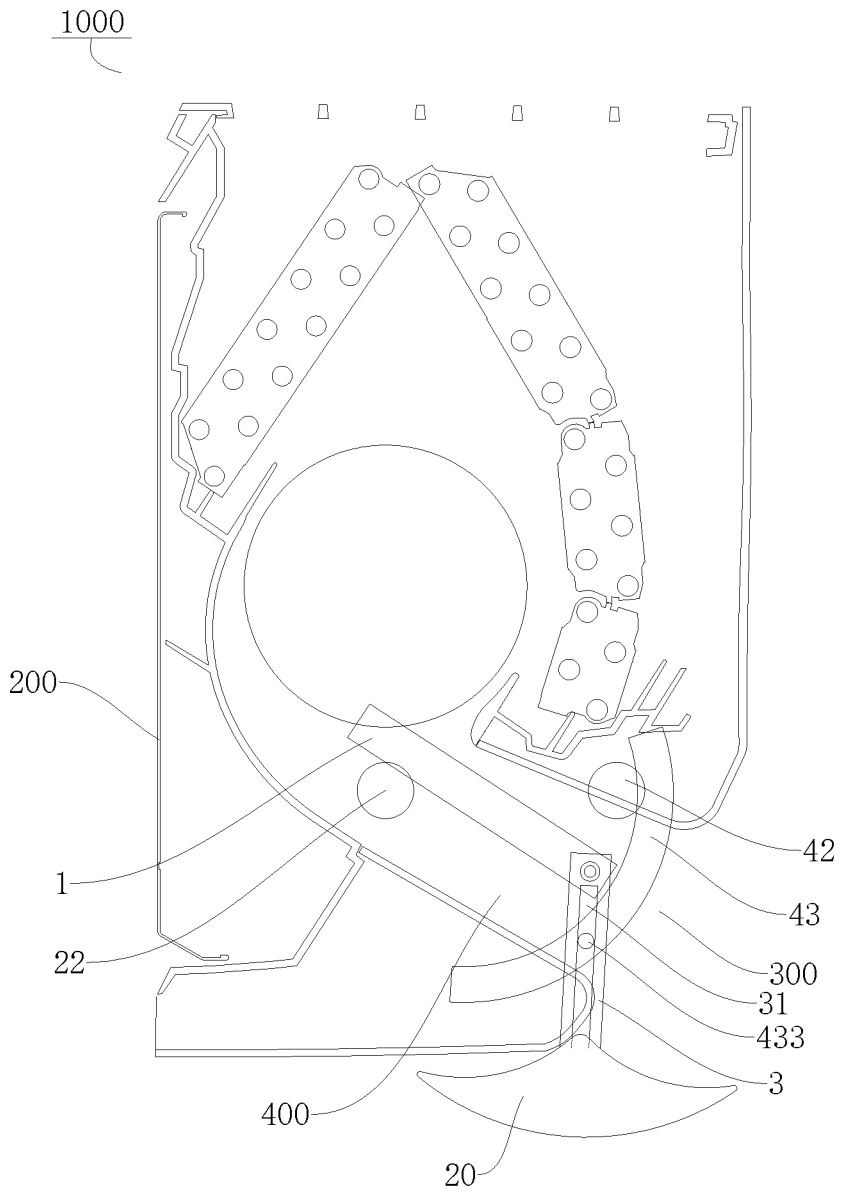
FIG. 5 is a cross-sectional view of an air conditioner according to an embodiment of the present disclosure with a deflector in a fifth state.
Figure 6:
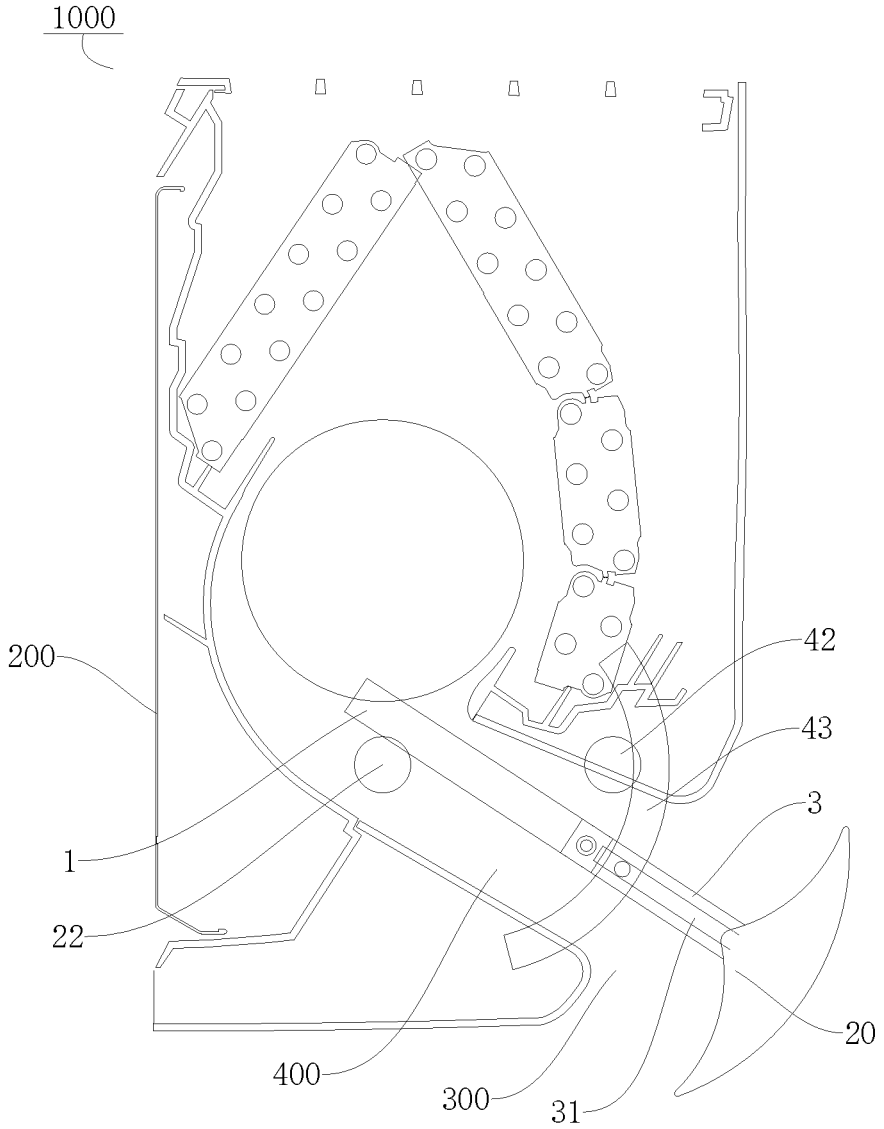
FIG. 6 is a cross-sectional view of an air conditioner according to an embodiment of the present disclosure with a deflector in a sixth state.

As illustrated in FIG. 6, on the basis of FIG. 2, the first driver assembly 2 is in operation to drive the first connection rod 1 to continue moving towards the air outlet 300 by a predetermined distance, which can enlarge upper and lower air outlets 300 formed between upper and lower ends of the deflector 20 and the air outlet 300 and thus facilitate an outflow of the airflow. As illustrated in FIG. 5, on the basis of FIG. 6, the first driver assembly 2 is in no operation, and the second connection rod 3 is driven by the second driver assembly 4 to rotate downwards. A downward swing angle of the deflector 20 may be greater than that shown in FIG. 4 to allow the deflector 20 to avoid the airflow, which enables the airflow to be blown out directly to achieve rapid cooling. On the basis of FIG. 6, the first driver assembly 2 is in no operation, and the second connection rod 3 may also be driven by the second driver assembly 4 to rotate upwards. An upward swing angle of the deflector 20 may be greater than that shown in FIG. 3 to allow the deflector 20 to avoid the airflow, which enables the airflow to be directly blown out.

Figure 7:
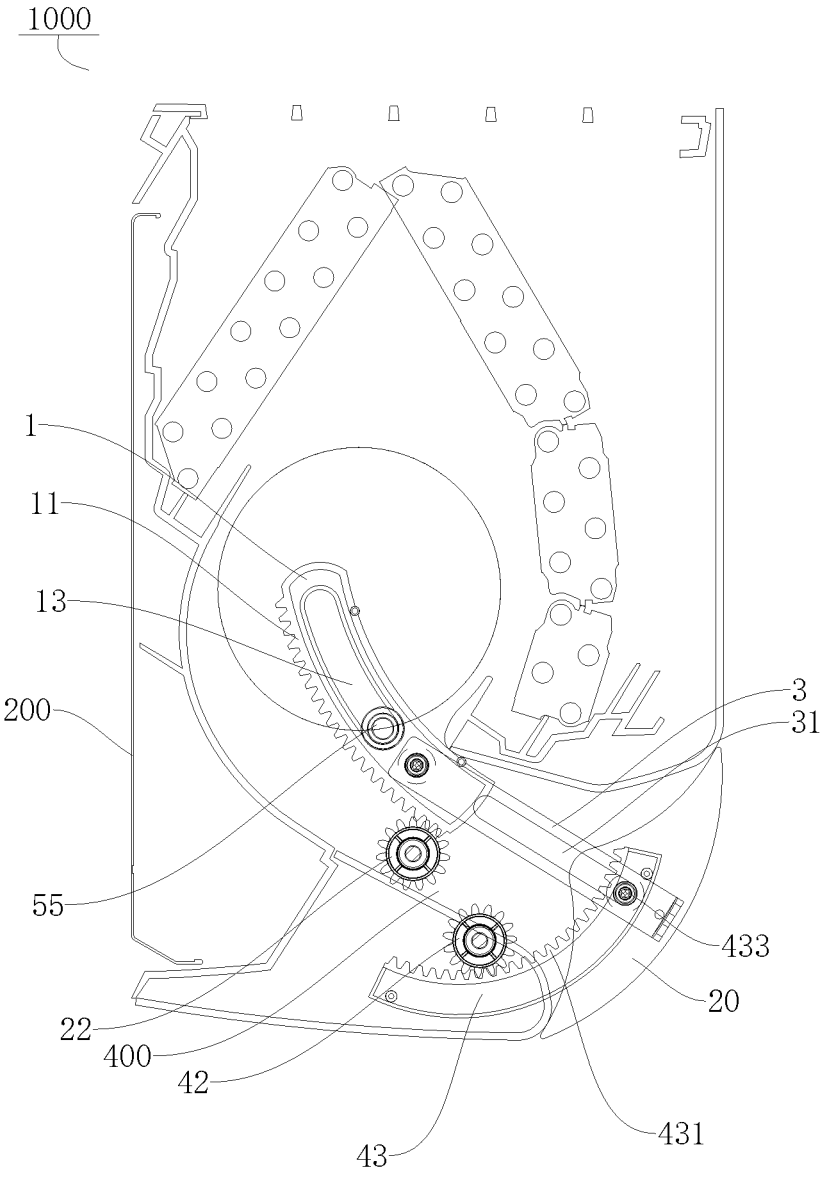
FIG. 7 is a cross-sectional view of an air conditioner according to another embodiment of the present disclosure with a deflector in a first state.
Figure 8:
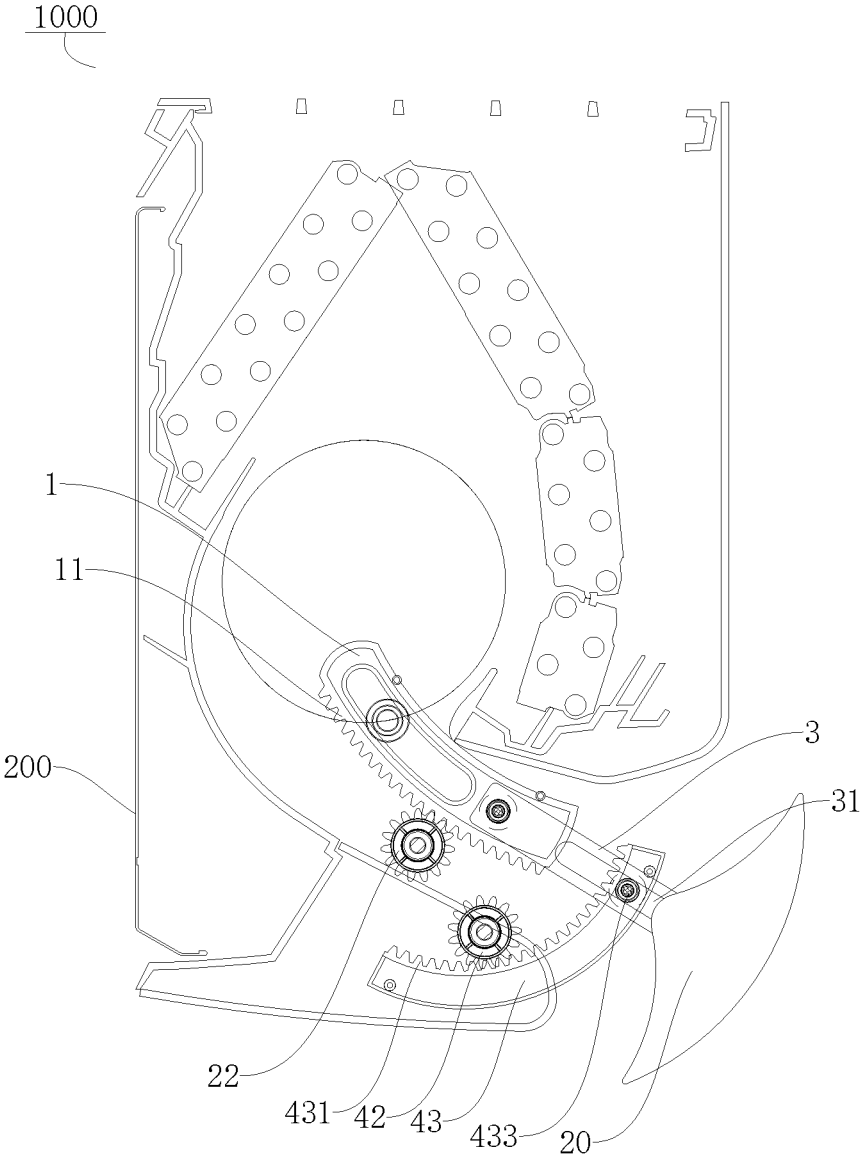
FIG. 8 is a cross-sectional view of an air conditioner according to yet another embodiment of the present disclosure with a deflector in a second state.
Figure 9:
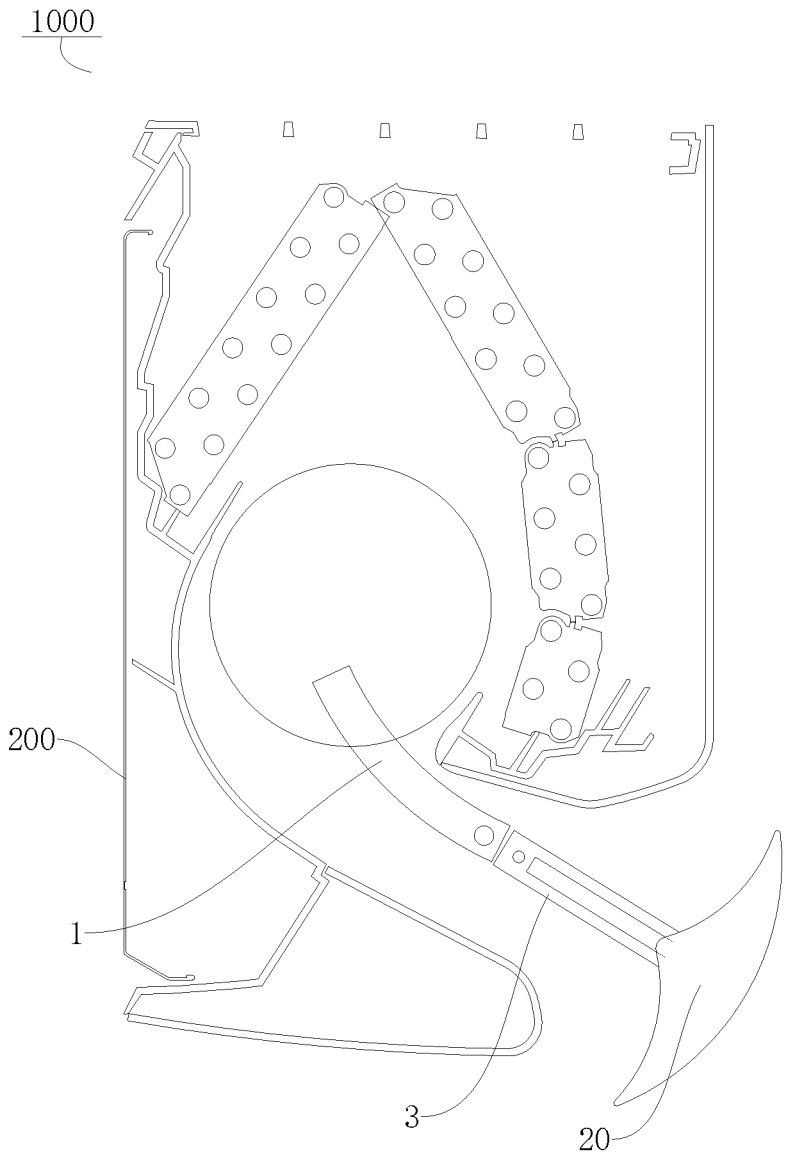
FIG. 9 is a simplified cross-sectional view of an air conditioner according to still yet another embodiment of the present disclosure with a deflector in a second state.
Figure 10:
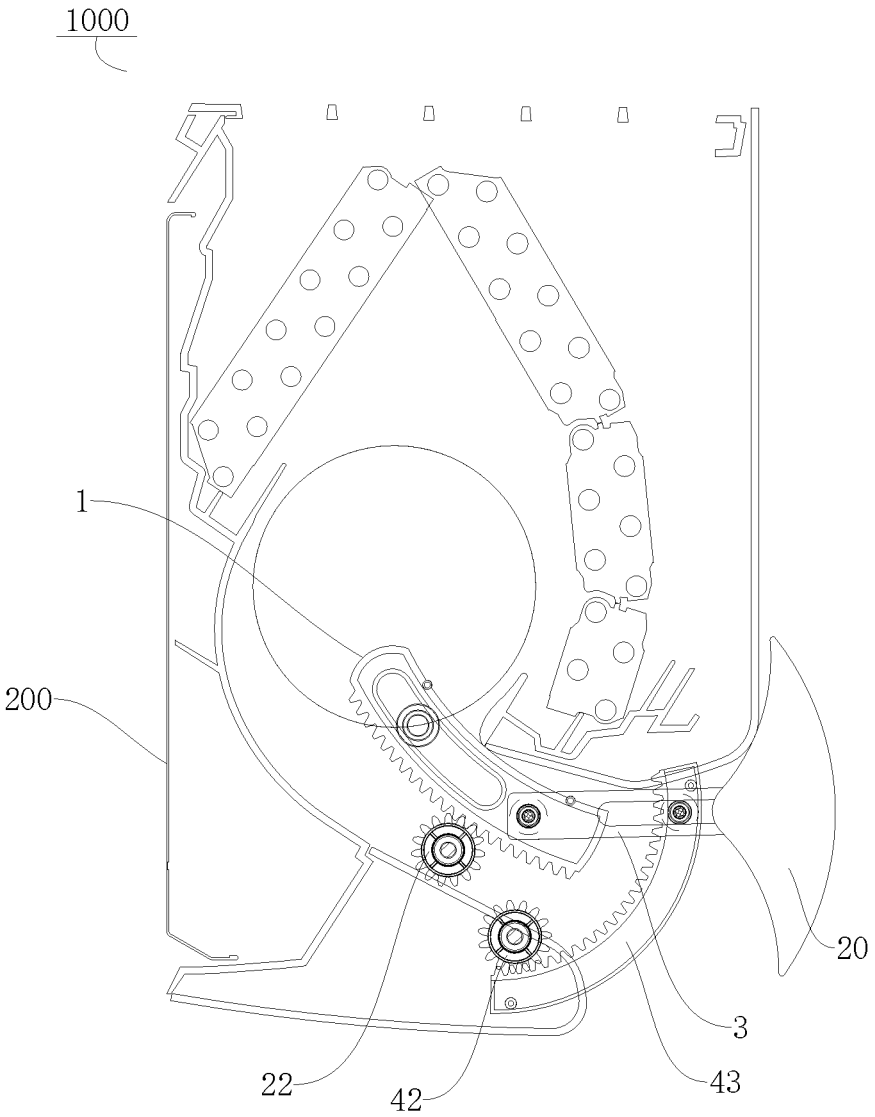
FIG. 10 is a cross-sectional view of an air conditioner according to still yet another embodiment of the present disclosure with a deflector in a third state.
Figure 11:
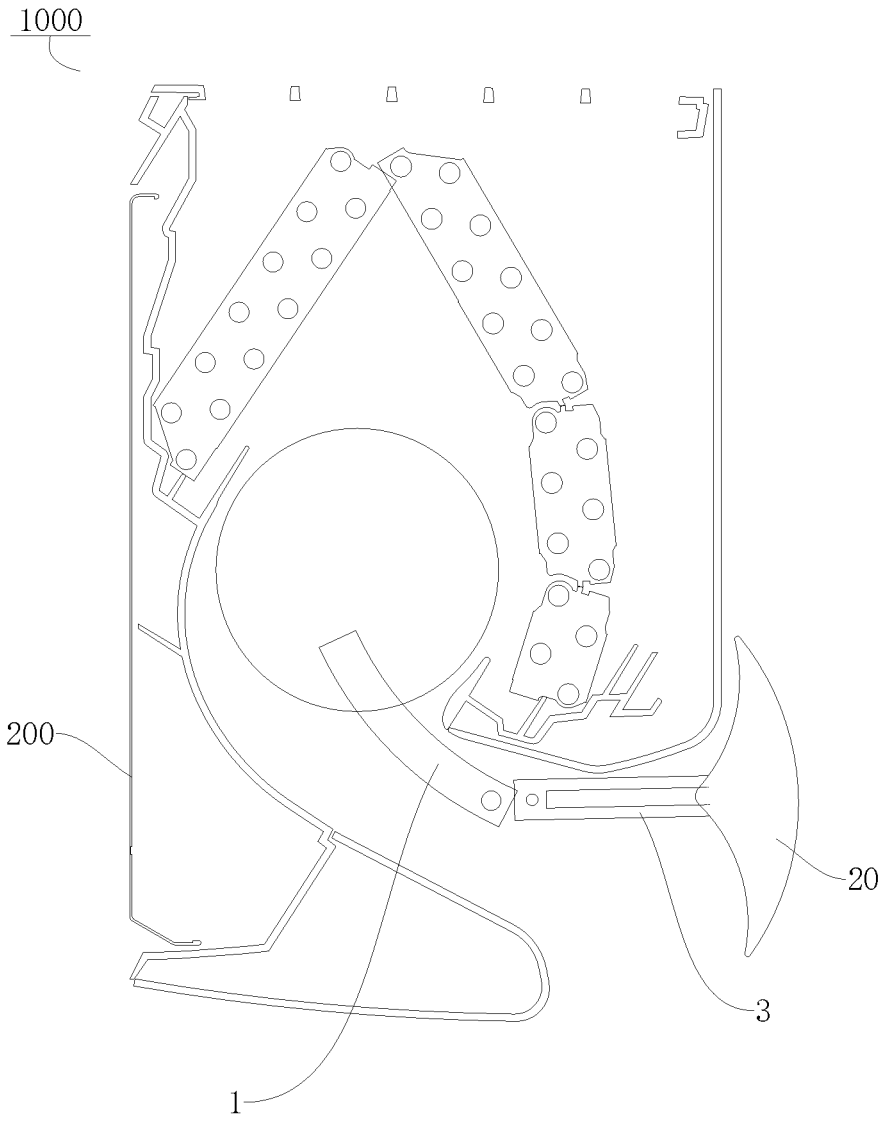
FIG. 11 is a simplified cross-sectional view of an air conditioner according to still yet another embodiment of the present disclosure with a deflector in a third state.
Figure 12:
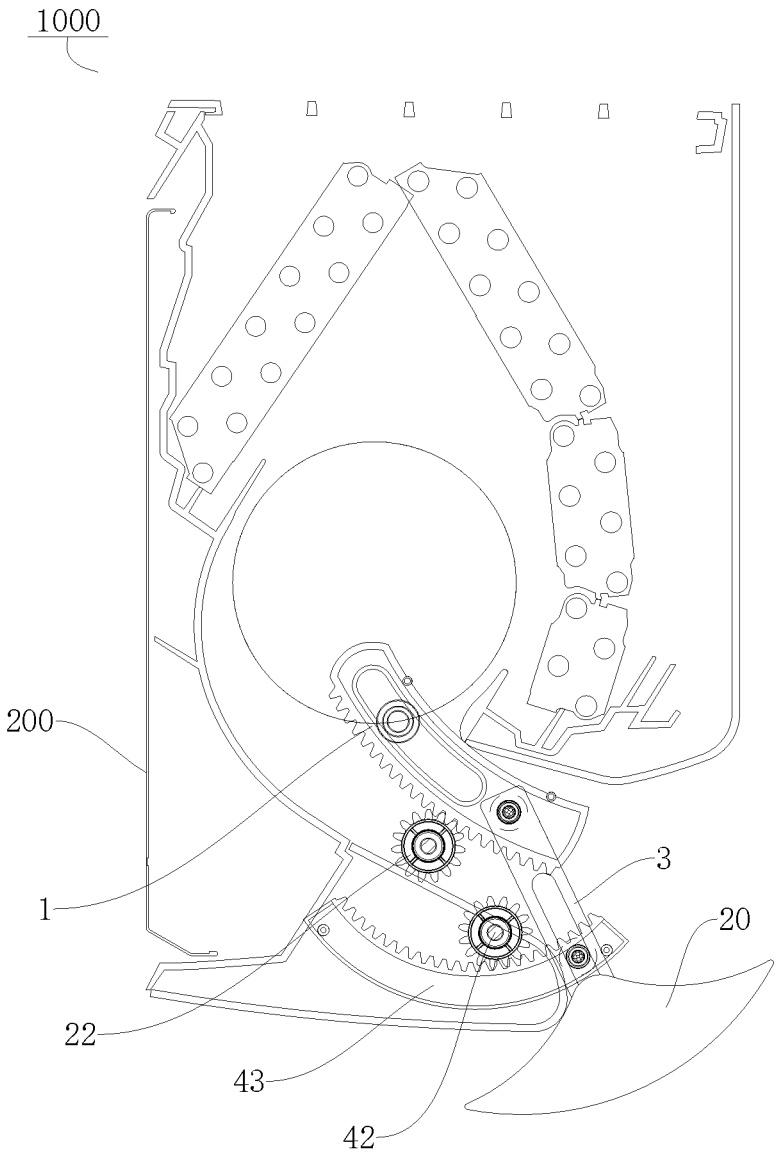
FIG. 12 is a cross-sectional view of an air conditioner according to still yet another embodiment of the present disclosure with a deflector in a fourth state.
Figure 13:
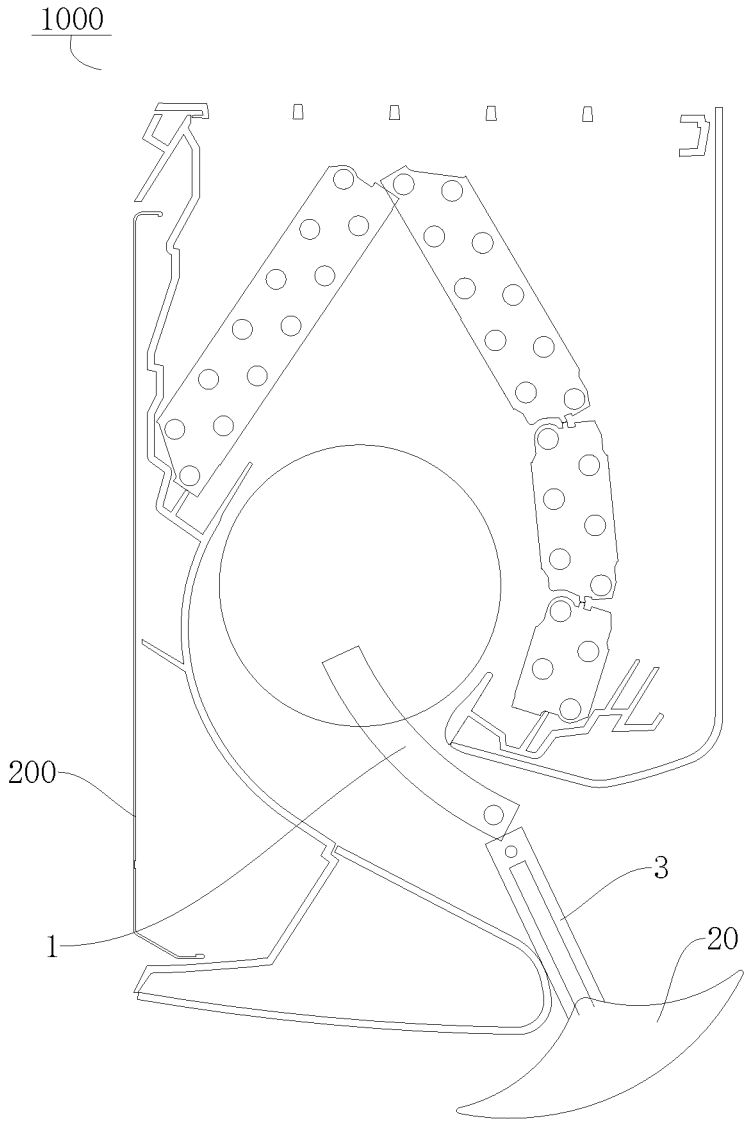
FIG. 13 is a simplified cross-sectional view of an air conditioner according to still yet another embodiment of the present disclosure with a deflector in a fourth state.

Reference can be made to FIG. 7 to FIG. 13. In another embodiment of the present disclosure, as illustrated in FIG. 7, when the first connection rod 1 and the second connection rod 3 are located in the initial position, the first connection rod 1 is located at a relatively inward position of the housing 200. The first connection rod 1 and the second connection rod 3 extend in the extending direction of the air outlet channel 400. The air outlet 300 is closed by the deflector 20. As illustrated in FIG. 2 and FIG. 3, the first connection rod 1 is driven by the first driver assembly 2 to move towards the air outlet 300 by a predetermined distance. The second driver assembly 4 is in no operation. The second connection rod 3 moves towards the air outlet 300 by the predetermined distance together with the first connection rod 1, and slides relative to the second driver assembly 4. In this way, the air outlet 300 is exposed by the deflector 20, and thus an airflow can flow out of the air outlet 300 in both the upward and downward directions of the air outlet 300. In this way, the air conditioner 1000 can realize both the upward air blowing and the downward air blowing. As illustrated in FIG. 10 and FIG. 11, on the basis of FIG. 8 and FIG. 9, the first driver assembly 2 is in no operation, and the second connection rod 3 is driven by the second driver assembly 4 to rotate upwards relative to the first connection rod 1. For example, when the distance between the deflector 20 and the housing 200 is smaller than or equal to 5 mm, the second driver assembly 4 stops its operation, which can allow the deflector 20 to be positioned at the upper limit position. As a result, the air conditioner 1000 can realize the downward air blowing. As illustrated in FIG. 12 and FIG. 13, on the basis of FIG. 8 and FIG. 9 or on the basis of FIG. 10 and FIG. 11, the first driver assembly 2 is in no operation, and the second connection rod 3 is driven by the second driver assembly 4 to rotate downwards relative to the first connection rod 1. For example, when the distance between the deflector 20 and the housing 200 is smaller than or equal to 5 mm, the second driver assembly 4 stops its operation, which can allow the deflector 20 to be positioned at the lower limit position. As a result, the air conditioner 1000 can realized the upward air blowing.

In this embodiment, on the basis of FIG. 8 and FIG. 9, the first driver assembly 2 may continue its operation to drive the first connection rod 1 to continue moving towards the air outlet 300 by a predetermined distance, which can enlarge the upper and lower air outlets 300 formed between the upper and lower ends of the deflector 20 and the air outlet 300 and thus facilitate the outflow of the airflow. On this basis, the first driver assembly 2 is in no operation, and the second connection rod 3 may also be driven by the second driver assembly 4 to rotate downwards or upwards. In this case, the swing angle of the deflector 20 increases as the distance by which the first connection rod 1 moves towards the air outlet 300 increases.

In the driver mechanism 10 for the air deflection mechanism 100 according to the embodiments of the present disclosure, the first connection rod 1 and the second connection rod 3 are provided. The first connection rod 1 is movably disposed in the housing 200 in the extending direction of the air outlet channel 400. The end of the second connection rod 3 is rotatably connected to the end of the first connection rod 1 adjacent to the air outlet 300, and the other end of the second connection rod 3 extends towards the air outlet 300. The deflector 20 is connected to the other end of the second connection rod 3 facing away from the first connection rod 1. In addition, the first connection rod 1 is driven by the first driver assembly 2 to move, and the second connection rod 3 is driven by the second driver assembly 4 to rotate relative to the first connection rod 1. In this way, the rotation center of the deflector 20 is variable, and the swing angle of the deflector 20 and the position of the deflector 20 relative to the housing 200 of the air conditioner 1000 can be adjusted. Thus, different air deflecting functions can be realized. Therefore, the air conditioner 1000 has a variety of air blowing modes, which can satisfy different demands of the user.

As illustrated in FIG. 1 and FIG. 7, a first rack 11 is disposed on the first connection rod 1. The first rack 11 extends in a length direction of the first connection rod 1. The first driver assembly 2 includes a first drive motor 21 and a first gear 22. The first drive motor 21 is disposed on the housing 200. The first gear 22 is connected to an output shaft of the first drive motor 21. The first gear 22 is engaged with the first rack 11. The first drive motor 21 operates to drive the first gear 22 to rotate. Through the engagement of the first gear 22 with the first rack 11, the first connection rod 1 can be driven to move, which can simplify a driving manner of the first connection rod 1 and ensure reliability of the movement of the first connection rod 1.

The present disclosure is not limited in this regard. The first driver assembly 2 may also be a lead screw driver mechanism. The first connection rod 1 is connected to a lead screw and moves along with the lead screw. A structure of the lead screw driver mechanism is well-known in the related art and thus the detailed description thereof will be omitted herein.

As illustrated in FIG. 1 and FIG. 7, a slide groove 31 is formed at the second connection rod 3 and extends in a length direction of the second connection rod 3. The second driver assembly 4 includes a second drive motor 41, a second gear 42, and a third connection rod 43. In some embodiments, the second drive motor 41 is disposed on the housing 200. The second gear 42 is connected to an output shaft of the second drive motor 41. The third connection rod 43 is movably disposed on the housing 200. A second rack 431 is disposed on the third connection rod 43. The second rack 431 extends in a length direction of the third connection rod 43 and is engaged with the second gear 42. A slider 433 is disposed on the third connection rod 43. The slider 433 is slidably disposed in the slide groove 31.

The second drive motor 41 operates to drive the second gear 42 to rotate. The third connection rod 43 may be driven to move through the engagement of the second gear 42 with the second rack 431. Through cooperation between the slider 433 and the slide groove 31 on the second connection rod 3, the second connection rod 3 is driven by the third connection rod 43 to rotate. Thus, the deflector 20 can be driven to swing to deflect the air at different angles.

In addition, when the second drive motor 41 is in no operation and the first connection rod 1 is driven by the first driver assembly 2 to move, the second connection rod 3 moves along with the first connection rod 1, and the slider 433 is slidable in the slide groove 31, which can ensure reliability of the movement of the second connection rod 3.

In some embodiments of the present disclosure, the third connection rod 43 extends along a straight line or an arc line. As illustrated in FIG. 1 to FIG. 13, the third connection rod 43 extends along the arc line. That is, the third connection rod 43 is an arc-shaped rod. Also, the third connection rod 43 is an arc-shaped rod protruding towards the air outlet 300. Due to cooperation between the third connection rod 43 and the second connection rod 3, the second connection rod 3 can rotate relative to the first connection rod 1. By forming the third connection rod 43 as the arc-shaped rod, it is possible to better ensure reliability of the cooperation between the third connection rod 43 and the second connection rod 3. The present disclosure is not limited in this regard. The third connection rod 43 may also extend along the straight line. That is, the third connection rod 43 is a straight rod. The straight third connection rod 43 can also achieve the cooperation between the slider 433 and the slide groove 31 on the second connection rod 3, and simplify the third connection rod 43 in structure and machining process and improve production efficiency.

In some embodiments of the present disclosure, the third connection rod 43 has a length greater than or equal to 40 mm, which can ensure that the deflector 20 has a sufficient swing angle. When the third connection rod 43 extends along the straight line, i.e., the third connection rod 43 is the straight rod, the length of the third connection rod 43 is a length of the third connection rod 43 in its extending direction. When two ends of the third connection rod 43 have edges non-parallel to the extending direction of the first connection rod 1, a shortest edge of the two ends of the third connection rod 43 in its length direction is measured as the length of the third connection rod 43. When the third connection rod 43 extends along the arc line, i.e., the third connection rod 43 is the arc-shaped rod, the length of the third connection rod 43 is a chord length of the third connection rod 43. The chord length is measured as a line connecting two ends of short edges of the third connection rod 43, i.e. as a line connecting two ends of edges of the third connection rod 43 that are close to a center of a circle in which the third connection rod 43 is located.

Figure 14:
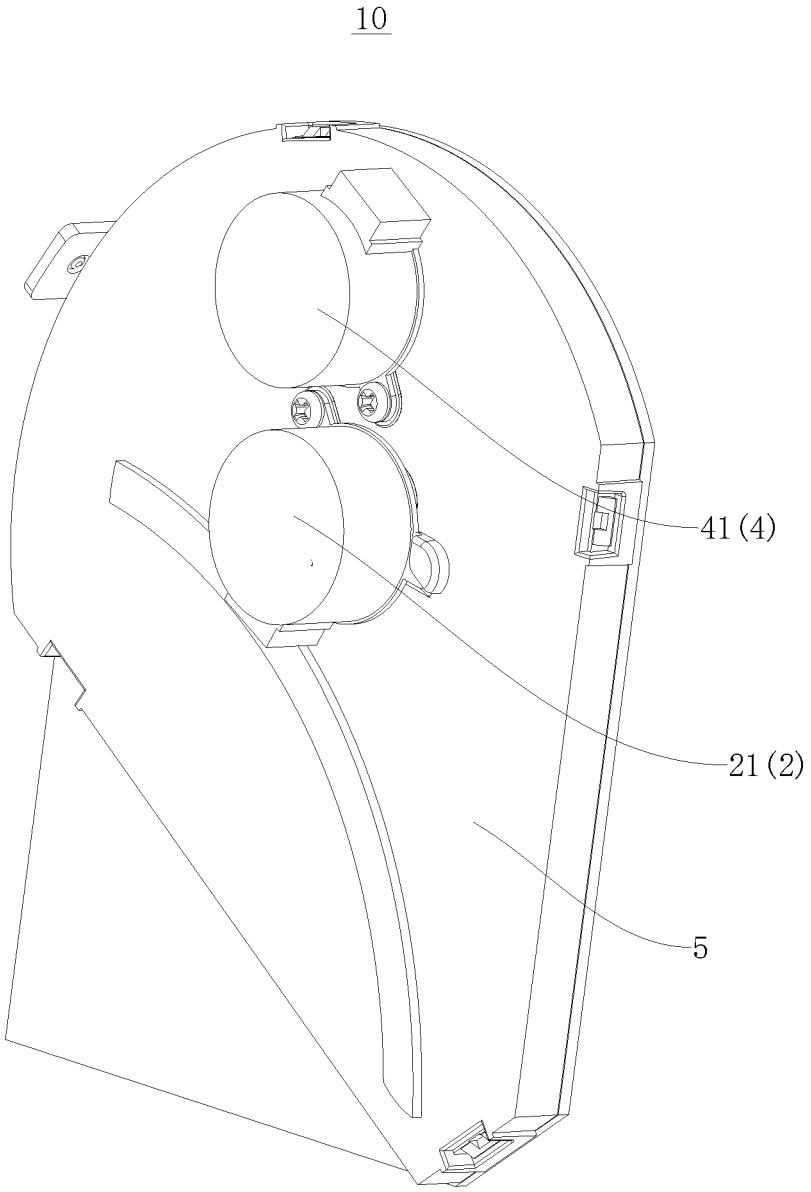
FIG. 14 is a perspective view of a driver mechanism for an air deflection mechanism according to an embodiment of the present disclosure.
Figure 15:
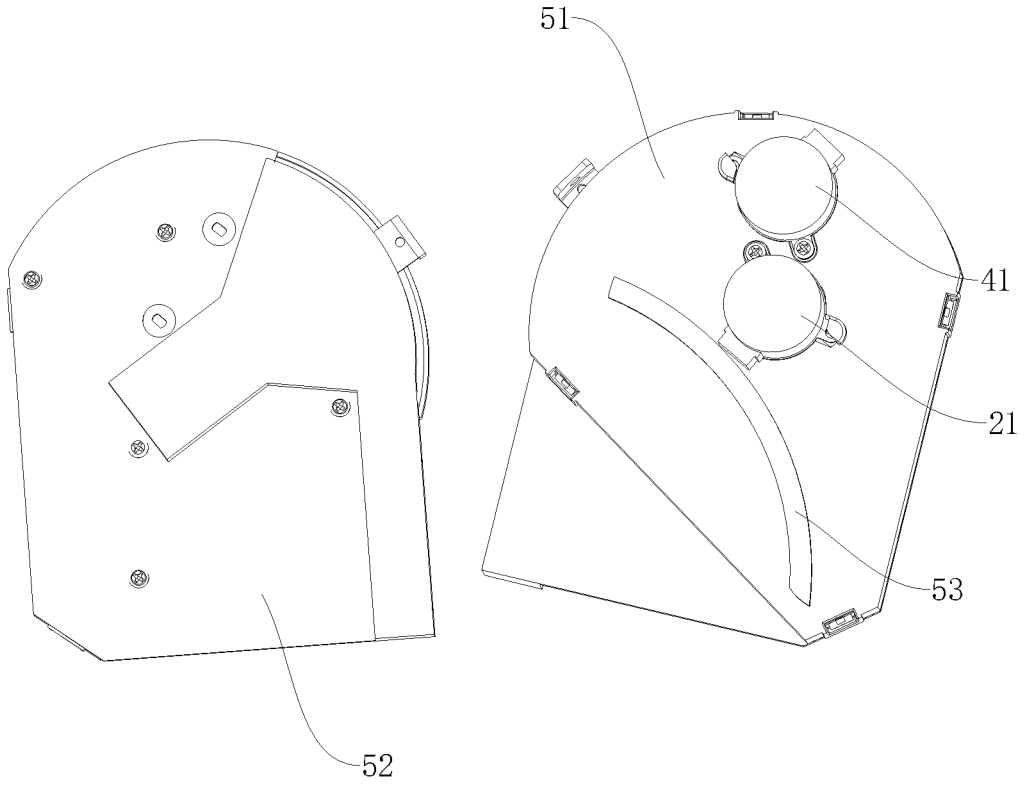
FIG. 15 is an exploded view of a driver mechanism for an air deflection mechanism according to an embodiment of the present disclosure.
Figure 16:
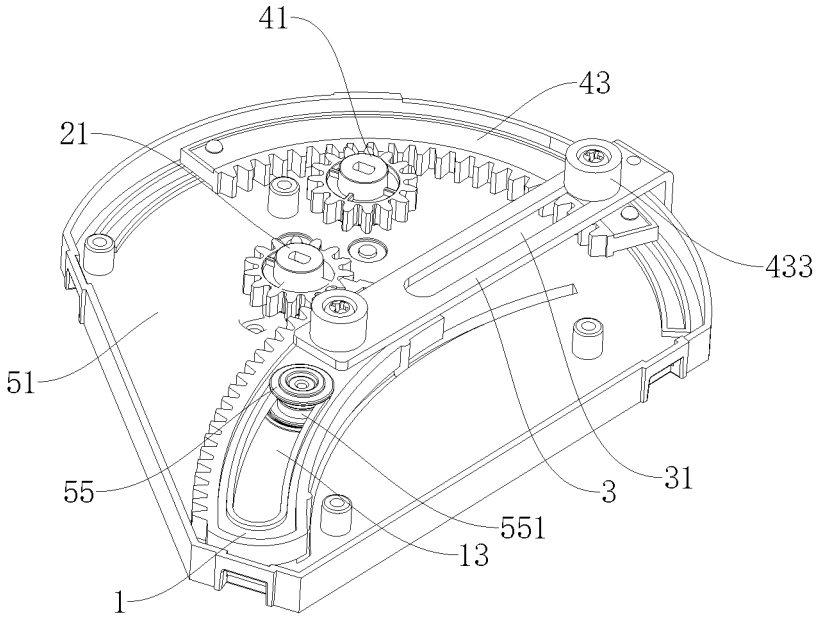
FIG. 16 is a partial structural view of a driver mechanism for an air deflection mechanism according to an embodiment of the present disclosure.

As illustrated in FIG. 19 to FIG. 25, the driver mechanism 10 further includes a drive box 5 disposed on the housing 200. The first connection rod 1, the first driver assembly 2, and the second driver assembly 4 are disposed on the drive box 5. In this way, the first connection rod 1, the first driver assembly 2, and the second driver assembly 4 can all be integrally mounted on the drive box 5, and the drive box 5 is mounted on the housing 200, which can facilitate mounting of the driver mechanism 10 and simplify assembly procedures of the driver mechanism 10. As illustrated in FIG. 14 to FIG. 16, the first connection rod 1 and the third connection rod 43 are movably disposed in the drive box 5. The other end of the second connection rod 3 extends out of the drive box 5. The first gear 22 and the second gear 42 are disposed in the drive box 5. The first drive motor 21 and the second drive motor 41 are disposed outside the drive box 5, and perpetrate the drive box 5 to be connected to the first gear 22 and the second gear 42, respectively.

Figure 17:
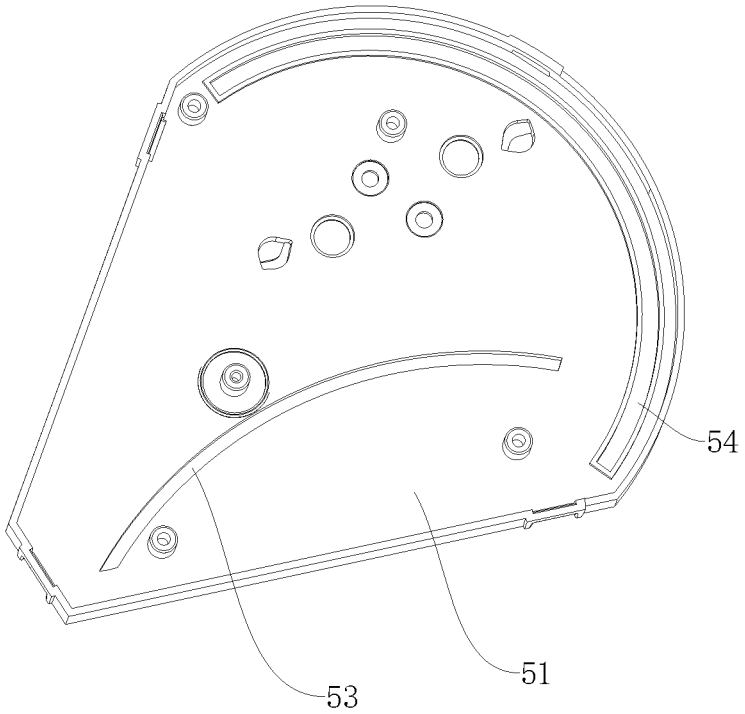
FIG. 17 is a structural view of a body of a drive box of a driver mechanism for an air deflection mechanism according to an embodiment of the present disclosure.
Figure 18:
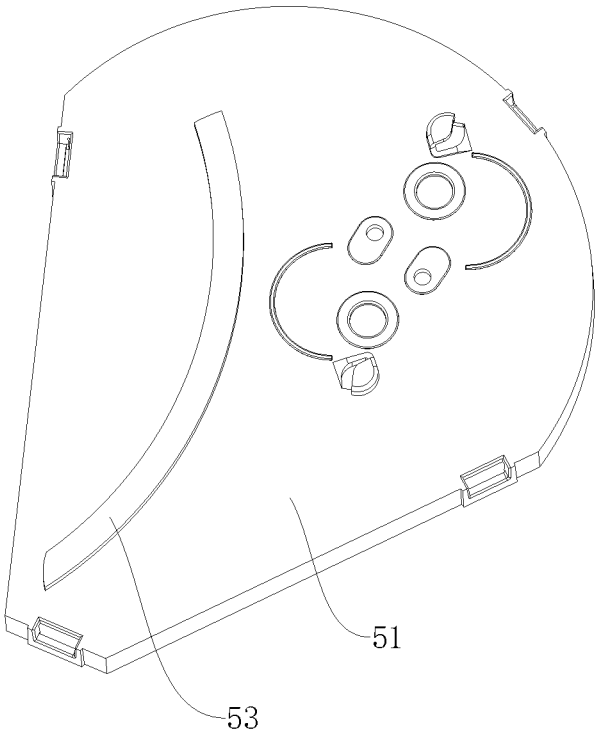
FIG. 18 is a structural view of a body of a drive box of a driver mechanism for an air deflection mechanism according to another embodiment of the present disclosure.
Figure 19:
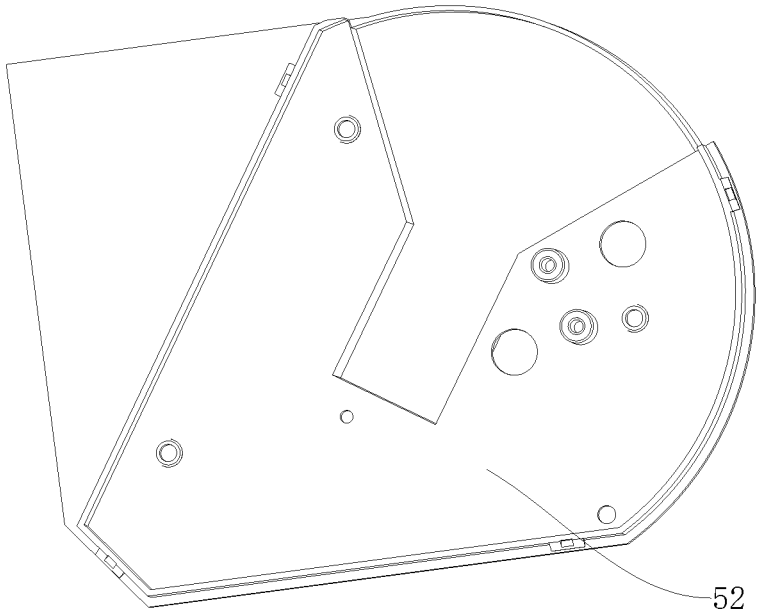
FIG. 19 is a structural view of a cover of a drive box of a driver mechanism for an air deflection mechanism according to an embodiment of the present disclosure.
Figure 20:
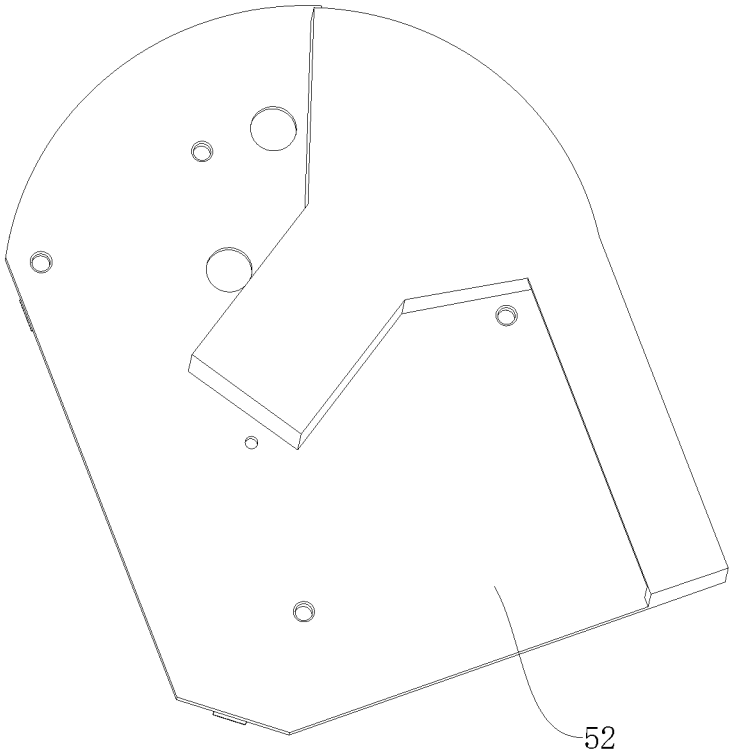
FIG. 20 is a structural view of a cover of a drive box of a driver mechanism for an air deflection mechanism according to another embodiment of the present disclosure.
Figure 21:
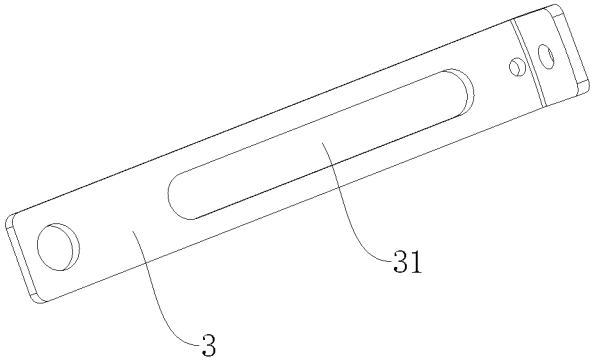
FIG. 21 is a perspective view of a second connection rod of a driver mechanism for an air deflection mechanism according to an embodiment of the present disclosure.
Figure 24:
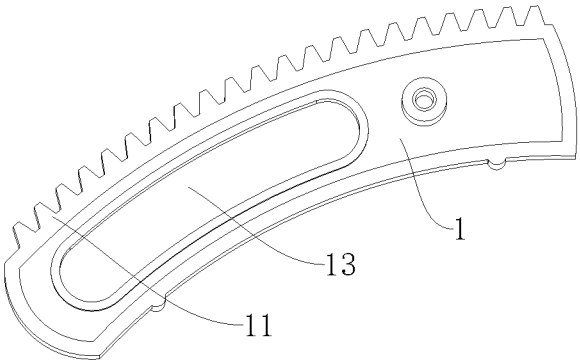
FIG. 24 is a perspective view of a first connection rod of a driver mechanism for an air deflection mechanism according to an embodiment of the present disclosure.
Figure 25:
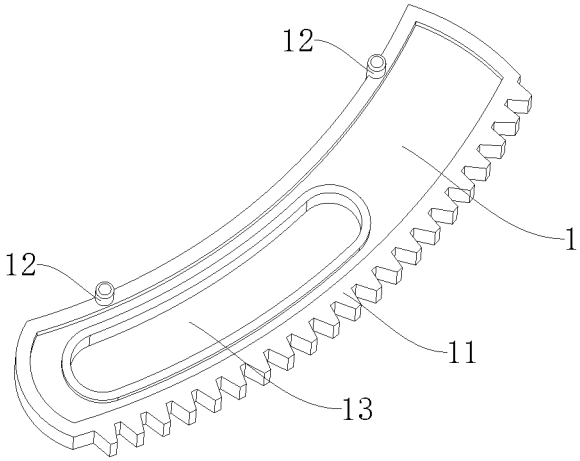
FIG. 25 is another perspective view of a first connection rod of a driver mechanism for an air deflection mechanism according to an embodiment of the present disclosure.

As illustrated in FIG. 24 and FIG. 25, at least two first guide posts 12 are disposed on the first connection rod 1. As illustrated in FIG. 17 and FIG. 18, a first guide groove 53 is formed at the drive box 5 and engaged with the at least two first guide posts 12. The at least two first guide posts 12 are spaced apart from each other in the length direction of the first connection rod 1. Thus, when the first connection rod 1 is driven by the first driver assembly 2 to move, it is possible to ensure that the first connection rod 1 can move along the first guide groove 53 to ensure a movement trajectory of the first connection rod 1. Thus, accuracy of movement position of the deflector 20 can be ensured.

The present disclosure is not limited in this regard. A guiding protrusion may be disposed on the first connection rod 1 and extends along the length direction of the first connection rod 1. A guide rail may be disposed on the drive box 5 and cooperates with the guiding protrusion. The movement trajectory of the first connection rod 1 can also be limited through the cooperation between the guide rail and the guiding protrusion. Or, the guide rail is disposed on the first connection rod 1, and the guiding protrusion is disposed on the drive box 5.

Figure 22:
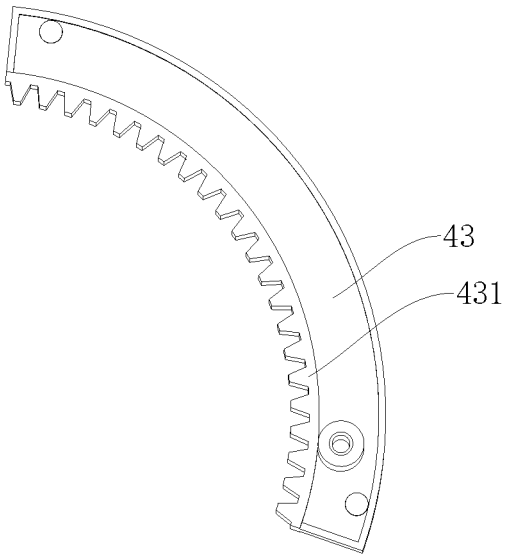
FIG. 22 is a perspective view of a third connection rod of a driver mechanism for an air deflection mechanism according to an embodiment of the present disclosure.
Figure 23:
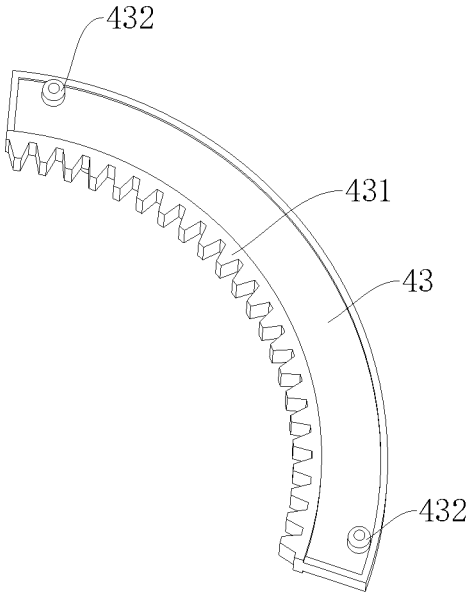
FIG. 23 is another perspective view of a third connection rod of a driver mechanism for an air deflection mechanism according to an embodiment of the present disclosure.

As illustrated in FIG. 17, FIG. 22, and FIG. 23, at least two second guide posts 432 are disposed on the third connection rod 43. A second guide groove 54 is formed at the drive box 5. The second guide groove 54 is engaged with the at least two second guide posts 432. The at least two second guide posts 432 are spaced apart from each other in the length direction of the third connection rod 43. Thus, when the third connection rod 43 is driven by the second driver assembly 4 to move, it is possible to ensure that the third connection rod 43 can move along the second guide groove 54 to ensure a movement trajectory of the third connection rod 43. Thus, accuracy of movement position of the deflector 20 can be ensured.

The present disclosure is not limited in this regard. A guiding protrusion may be disposed on the third connection rod 43 and extend along the length direction of the third connection rod 43. A guide rail may be disposed on the drive box 5 and cooperates with the guiding protrusion. The movement trajectory of the third connection rod 43 can also be limited through the cooperation between the guide rail and the guiding protrusion. Or, the guide rail is disposed on the third connection rod 43, and the guiding protrusion is disposed on the drive box 5.

Further, as illustrated in FIG. 16 and FIG. 17, a guide wheel 55 is rotatably disposed in the drive box 5. An engagement groove 551 is formed at a circumferential wall of the guide wheel 55 and extends in a circumferential direction of the guide wheel 55. A guide channel 13 is formed in the first connection rod 1 and extends in the length direction of the first connection rod 1. The first connection rod 1 is engaged into the engagement groove 551 at each of two opposite side edges of the guide channel 13. Thus, the first connection rod 1 can be further guided to facilitate the movements of the first connection rod 1. Further, the movements of the first connection rod 1 can also be guided.

As illustrated in FIG. 15, the drive box 5 includes a body 51 and a cover 52. The body 51 is connected to, e.g., engaged with, the cover 52 to form a mounting space. The first connection rod 1, the first driver assembly 2, and the second driver assembly 4 are disposed on the body 51.

In some embodiments of the present disclosure, the driver mechanism 10 may not include the drive box 5. In this case, the first connection rod 1, the first driver assembly 2, and the second driver assembly 4 may be disposed directly on the housing 200. The at least two first guide posts 12 are disposed on one of the housing 200 and the first connection rod 1, and the first guide groove 53 is formed at the other one of the housing 200 and the first connection rod 1. The at least two first guide posts 12 are slidably disposed in the first guide groove 53, and are spaced apart from each other in the length direction of the first connection rod 1. Thus, when the first connection rod 1 is driven by the first driver assembly 2 to move, it is possible to ensure that the first connection rod 1 can move along the first guide groove 53 to ensure the movement trajectory of the first connection rod 1. Thus, the accuracy of the movement position of the deflector 20 can be ensured.

The at least two second guide posts 432 are disposed on one of the housing 200 and the third connection rod 43, and the second guide groove 54 is formed at the other one of the housing 200 and the third connection rod 43. The at least two second guide posts 432 are slidably disposed in the second guide groove 54, and are spaced apart from each other in the length direction of the third connection rod 43. Thus, when the third connection rod 43 is driven by the second driver assembly 4 to move, it is possible to ensure that the third connection rod 43 can move along the second guide groove 54 to ensure the movement trajectory of the third connection rod 43. Thus, the accuracy of the movement position of the deflector 20 can be ensured.

In some embodiments of the present disclosure, at least one of the first connection rod 1 and the second connection rod 3 extends along a straight line or an arc line. The first connection rod 1 may extend along the straight line or the arc line, while the second connection rod 3 may also extend along the straight line or the arc line. For example, in examples illustrated in FIG. 1 to FIG. 6, the first connection rod 1 extends along the straight line, and the second connection rod 3 extends along the straight line. In examples illustrated in FIG. 7 to FIG. 13, the first connection rod 1 extends along the arc line, and the second connection rod 3 extends along the straight line.

In some embodiments of the present disclosure, the first connection rod 1 has a length greater than or equal to 40 mm, which can ensure that the rotation center of the deflector 20 has a sufficient range of movement. When the first connection rod 1 extends along the straight line, i.e., the first connection rod 1 is a straight rod, the length of the first connection rod 1 is a length of the first connection rod 1 in its extending direction. When two ends of the first connection rod 1 have edges non-parallel to the extending direction of the first connection rod 1, a shortest edge of the two ends of the first connection rod 1 in its length direction is measured as the length of the first connection rod 1. When the first connection rod 1 extends along the arc line, i.e., the first connection rod 1 is an arc-shaped rod, the length of the first connection rod 1 is a chord length of the first connection rod 1. The chord length is measured as a line connecting two ends of short edges of the first connection rod 1, i.e., as a line connecting two ends of edges of the first connection rod 1 that are close to a center of a circle in which the first connection rod 1 is located.

In some embodiments of the present disclosure, the second connection rod 3 has a length greater than or equal to 40 mm, which can ensure that the deflector 20 has a sufficient range of swinging. When the second connection rod 3 extends along the straight line, i.e., the second connection rod 3 is a straight rod, the length of the second connection rod 3 is a length of the second connection rod 3 in its extending direction. When two ends of the second connection rod 3 have edges non-parallel to the extending direction of the third connection rod 3, a shortest edge of the two ends of the third connection rod 3 in its length direction is measured as the length of the third connection rod 3. When the second connection rod 3 extends along the arc line, i.e., the second connection rod 3 is an arc-shaped rod, the length of the second connection rod 3 is a chord length of the second connection rod 3. The chord length is measured as a line connecting two ends of short edges of the second connection rod 3, i.e., as a line connecting two ends of edges of the second connection rod 3 that are adjacent to a center of a circle in which the second connection rod 3 is located.

Figure 26:
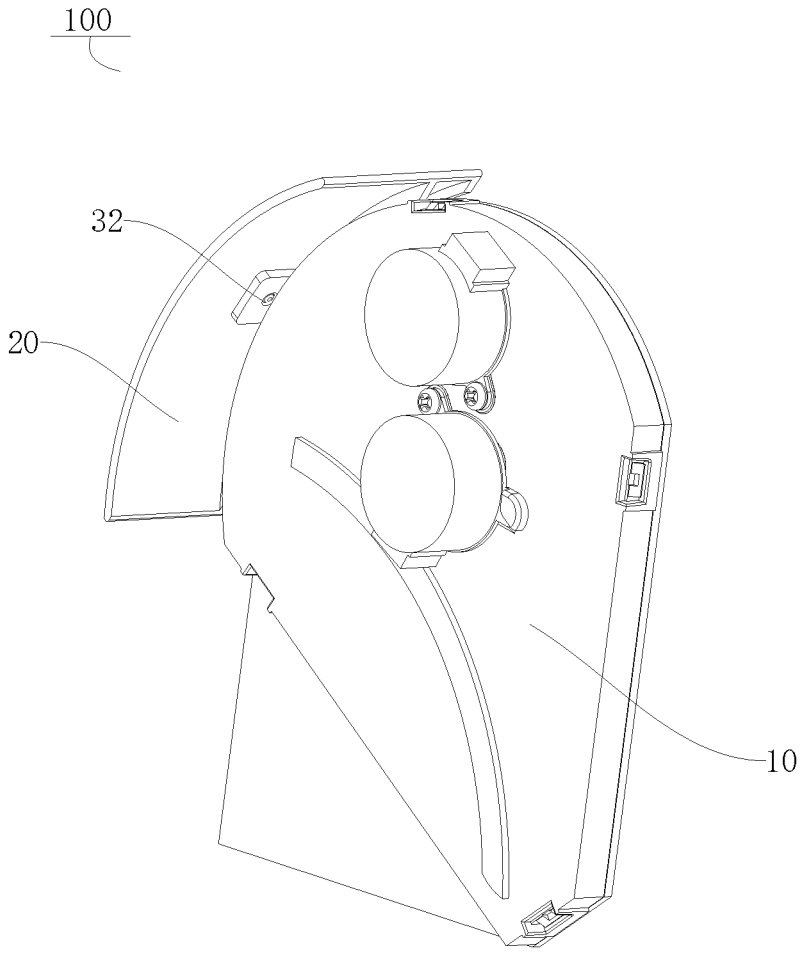
FIG. 26 is a schematic partial structural view of an air deflection mechanism according to an embodiment of the present disclosure.
Figure 27:
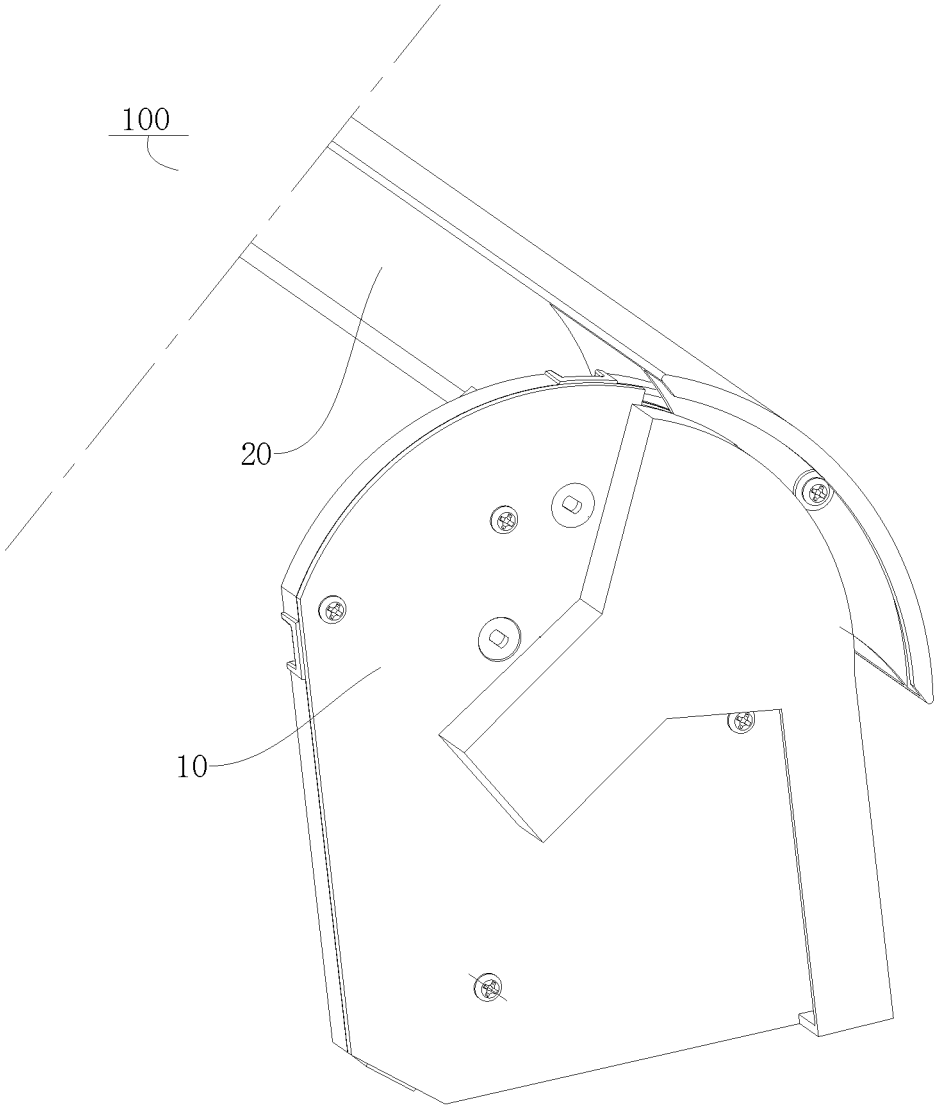
FIG. 27 is another schematic partial structural view of an air deflection mechanism according to an embodiment of the present disclosure.
Figure 28:
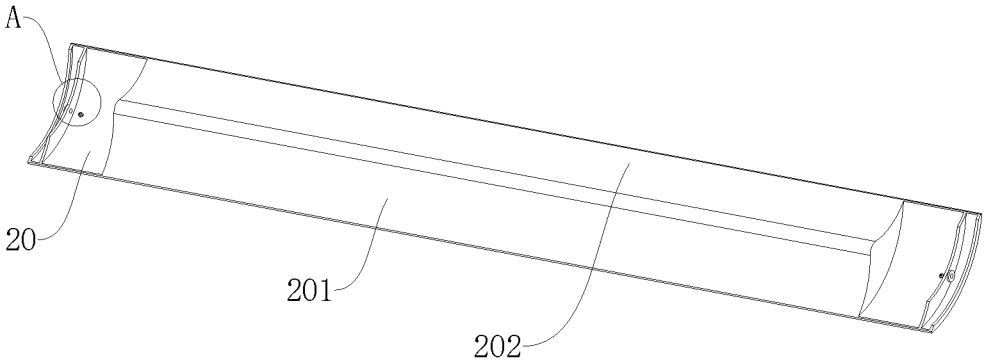
FIG. 28 is a perspective view of a deflector according to an embodiment of the present disclosure.
Figure 29:
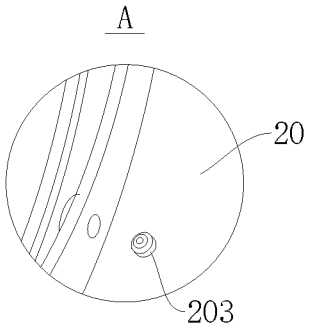
FIG. 29 is an enlarged view of part A in FIG. 28.

As illustrated in FIG. 26 to FIG. 28, the air deflection mechanism 100 according to the embodiments of the present disclosure includes the driver mechanism 10 as described above and a deflector 20.

In some embodiments, the deflector 20 is immovably connected to the other end of the second connection rod 3 facing away from the first connection rod 1. The deflector 20 is movable along with the other end of the second connection rod 3 facing away from the first connection rod 1, to adjust the position of the deflector 20. In this way, the deflector 20 has a variety of air deflecting modes. As a result, the air conditioner 1000 can have a variety of air blowing modes. Thus, different demands of the user can be satisfied.

In the air deflection mechanism 100 according to the embodiments of the present disclosure, the first connection rod 1 and the second connection rod 3 are provided. The first connection rod 1 is movably disposed in the housing 200 in the extending direction of the air outlet channel 400. The end of the second connection rod 3 is rotatably connected to the end of the first connection rod 1 close to the air outlet 300, and the other end of the second connection rod 3 extends towards the air outlet 300. The deflector 20 is connected to the other end of the second connection rod 3 facing away from the first connection rod 1. In addition, the first connection rod 1 is driven by the first driver assembly 2 to move, and the second connection rod 3 is driven by the second driver assembly 4 to rotate relative to the first connection rod 1. In this way, the rotation center of the deflector 20 is variable, and the swing angle of the deflector 20 and the position of the deflector 20 relative to the housing 200 of the air conditioner 1000 can be adjusted. Thus, different air deflecting functions can be realized. Therefore, the air conditioner 1000 has a variety of air blowing modes, which can satisfy different demands of the user.

Further, two driver mechanisms 10 are provided. Correspondingly, two second connection rods 3 are provided. The two second connection rods 3 and the two driver mechanisms 10 are in one-to-one correspondence. Both ends of the deflector 20 in a length direction thereof are connected to the two second connection rods 3, respectively. The two driver mechanisms 10 can drive the both ends of the deflector 20 in the length direction of the deflector respectively, which can ensure reliability of the movement of the deflector 20. As a result, it is possible to ensure that the deflector 20 moves to a fixed position more accurately.

As illustrated in FIG. 27 and FIG. 28, the deflector 20 and the second connection rods 3 are connected by screws. Meanwhile, positioning posts 203 are disposed on the deflector 20. A positioning hole 32 is formed at each second connection rod 3. The positioning posts 203 are engaged into the positioning hole 32, respectively. In this way, positioning between the second connection rods 3 and the deflector 20 can be realized to facilitate connections between the deflector 20 and the second connection rods 3. As a result, reliability of the connections between the deflector 20 and the second connection rod 3 can be improved.

As illustrated in FIG. 28, a surface of the deflector 20 facing towards the air outlet 300 includes a first surface 201 and a second surface 202 in a width direction of the deflector 20. One edge of the first surface 201 is connected to one edge of the second surface 202. The other edge of each of the first surface 201 and the second surface 202 extends towards a surface of the deflector 20 facing away from the air outlet 300. A connection between each second connection rod 3 and the deflector 20 is coincident with a connecting line between the first surface 201 and the second surface 202. Both the first surface 201 and the second surface 202 may be constructed as air deflecting surfaces. Thus, the first surface 201 and the second surface 202 facilitate deflecting of the airflow when the air outlet 300 is exposed by the deflector 20 and air is blown out at both upper and lower sides of the air outlet 300.

In some embodiments of the present disclosure, each of the first surface 201 and the second surface 202 is a curved surface such as an arc surface protruding towards a side of the deflector 20 facing away from the air outlet 300, which can further improve performance of the first surface 201 and the second surface 202 in deflecting the airflow.

An air conditioner 1000 according to embodiments of the present disclosure includes the air deflection mechanism 100 as described above.

In the air conditioner 1000 according to the embodiments of the present disclosure, the first connection rod 1 and the second connection rod 3 are provided. The first connection rod 1 is movably disposed in the housing 200 in the extending direction of the air outlet channel 400. The end of the second connection rod 3 is rotatably connected to the end of the first connection rod 1 close to the air outlet 300, and the other end of the second connection rod 3 extends towards the air outlet 300. The deflector 20 is connected to the other end of the second connection rod 3 facing away from the first connection rod 1. In addition, the first connection rod 1 is driven by the first driver assembly 2 to move, and the second connection rod 3 is driven by the second driver assembly 4 to rotate relative to the first connection rod 1. In this way, the rotation center of the deflector 20 is variable, and the swing angle of the deflector 20 and the position of the deflector 20 relative to the housing 200 of the air conditioner 1000 can be adjusted. Thus, different air deflecting functions can be realized. Therefore, the air conditioner 1000 has a variety of air blowing modes, which can satisfy different demands of the user.

The air conditioner 1000 according to the embodiments of the present disclosure has several operation modes as follows.

In a first operation mode, after the air conditioner 1000 is turned on, the first gear 22 rotates to push an air deflecting device away from a body of the air conditioner 1000, while the second gear 42 is in no rotation. In this way, the air deflection mechanism 100 is pushed to a position illustrated in FIG. 2 or FIG. 6. Thus, both an upward air blowing and a downward air blowing can be realized.

In a second operation mode, after the air conditioner 1000 is turned on, the first gear 22 rotates to push the air deflecting device away from the body of the air conditioner 1000, and the second gear 42 rotates simultaneously or subsequently in a counterclockwise direction. The second gear 42 does not stop its operation until a distance between the air deflection mechanism 100 and the body of the air conditioner 1000 is smaller than or equal to 5 mm, and is located in a state illustrated in FIG. 3. Thus, the downward air blowing can be realized.

In a third operation mode 3, after the air conditioner 1000 is turned on, the first gear 22 rotates to push the air deflecting device facing away from the body of the air conditioner 1000, and the second gear 42 rotates simultaneously or subsequently in a clockwise direction. The second gear 42 does not stop its operation until the distance between the air deflection mechanism 100 and the body is smaller than or equal to 5 mm, and is located in a state illustrated in FIG. 4. Thus, the upward air blowing can be realized.

In a fourth operation mode, in the state illustrated in FIG. 4, the first gear 22 rotates and continues pushing the air deflection mechanism 100 outwards. In this case, the air deflection mechanism 100 will rotate about the slider 433 into a state illustrated in FIG. 5 to avoid the air outlet. Thus, no or less air may be blocked to allow the airflow to be blown out directly.

In a fifth operation mode 5, the second gear 42 rotates back and forth in the clockwise direction and the counterclockwise direction, which can achieve an air swinging effect.

In the description of the present disclosure, it should be understood that the orientation or position relationship indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc., is based on the orientation or position relationship shown in the drawings, and is merely for the convenience of describing the present disclosure and simplifying the description, rather than indicating or implying that the referred device or element must have a specific orientation, or be constructed and operated in a specific orientation, and therefore cannot be understood as a limitation of the present disclosure. In addition, the features associated with "first" and "second" may explicitly or implicitly include at least one of the features. In the description of the present disclosure, "plurality" means at least two, unless otherwise specifically defined.

In the description of the present disclosure, it should be noted that, unless otherwise clearly specified and limited, terms such as "install", "connect", "connect to" and the like should be understood in a broad sense. For example, it may be a fixed connection or a detachable connection or connection as one piece; mechanical connection or electrical connection; direct connection or indirect connection through an intermediate; or internal communication of two components. For those of ordinary skill in the art, specific meanings of the above-mentioned terms in the present disclosure can be understood according to specific circumstances.

In the description of this specification, description with reference to the terms "an embodiment", "some embodiments", "schematic embodiments", "example", "specific examples", "some examples", etc., means that specific features, structure, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials, or characteristics may be combined in any one or more embodiments or examples in a suitable manner.

Although the embodiments of the present disclosure have been illustrated and described, it is conceivable for those of ordinary skill in the art that various changes, modifications, replacements, and variations can be made to these embodiments without departing from the principles and spirit of the present disclosure. The scope of the present disclosure shall be defined by the claims as appended and their equivalents.

What is claimed is:

1. A driver mechanism comprising:

a first connection rod movably disposed in a housing of an air conditioner in an extending direction of an air outlet channel in the housing;

a first driver assembly disposed at the housing, the first driver assembly being connected to the first connection rod to drive the first connection rod to move;

a second connection rod, a first end of the second connection rod being rotatably connected to an end of the first connection rod close to an air outlet formed at the housing and in communication with the air outlet channel, a second end of the second connection rod extending towards the air outlet, the second end of the second connection rod being directly fixedly connected to a deflector of the air conditioner to drive the deflector to expose or close the air outlet, and the deflector being not directly connected to the first connection rod; and a second driver assembly disposed at the housing, the second driver assembly being connected to the second connection rod to drive the second connection rod to rotate relative to the first connection rod, and the second driver assembly being slidable relative to the second connection rod.

2. The driver mechanism according to claim 1, wherein:

a rack is provided at the first connection rod and extends in a length direction of the first connection rod; and the first driver assembly includes:

a drive motor disposed at the housing; and a gear connected to an output shaft of the drive motor and engaged with the rack.

3. The driver mechanism according to claim 1, wherein:

a slide groove is formed at the second connection rod and extends in a length direction of the second connection rod; and the second driver assembly includes:

a drive motor disposed at the housing;

a gear connected to an output shaft of the drive motor; and a third connection rod movably disposed at the housing, a second rack being disposed on the third connection rod, the second rack extending in a length direction of the third connection rod and being engaged with the second gear, and a slider being disposed at the third connection rod and slidably arranged in the slide groove.

4. The driver mechanism according to claim 3, wherein the third connection rod extends along a straight line or an arc line.

5. The driver mechanism according to claim 3, further comprising:

a drive box disposed at the housing;

wherein:

the first connection rod, the first driver assembly, and the second driver assembly are disposed at the drive box;

the first connection rod and the third connection rod are movably disposed in the drive box;

the second end of the second connection rod extends out of the drive box;

at least two first guide posts are disposed at the first connection rod and spaced apart from each other in a length direction of the first connection rod;

a first guide groove is formed at the drive box and engaged with the at least two first guide posts;

at least two second guide posts are disposed at the third connection rod and spaced apart from each other in the length direction of the third connection rod; and a second guide groove is formed at the drive box and engaged with the at least two second guide posts.

6. The driver mechanism according to claim 5, wherein:

a guide wheel is rotatably disposed in the drive box, an engagement groove being formed at a circumferential wall of the guide wheel and extending in a circumferential direction of the guide wheel;

a guide channel is formed at the first connection rod and extends in the length direction of the first connection rod; and the first connection rod is engaged in the engagement groove at each of two opposite side edges of the guide channel.

7. The driver mechanism according to claim 3, wherein the third connection rod has a length greater than or equal to 40 mm.

8. The driver mechanism according to claim 1, wherein at least one of the first connection rod or the second connection rod extends along a straight line or an arc line.

9. The driver mechanism according to claim 1, wherein the first connection rod has a length greater than or equal to 40 mm.

10. The driver mechanism according to claim 1, wherein the second connection rod has a length greater than or equal to 40 mm.

11. An air deflection mechanism comprising:

a driver mechanism including:

a first connection rod movably disposed in a housing of an air conditioner in an extending direction of an air outlet channel in the housing;

a first driver assembly disposed at the housing, the first driver assembly being connected to the first connection rod to drive the first connection rod to move;

a second connection rod, a first end of the second connection rod being rotatably connected to an end of the first connection rod close to an air outlet formed at the housing and in communication with the air outlet channel, a second end of the second connection rod extending towards the air outlet; and a second driver assembly disposed at the housing, the second driver assembly being connected to the second connection rod to drive the second connection rod to rotate relative to the first connection rod, and the second driver assembly being slidable relative to the second connection rod; and a deflector directly fixedly connected to the second end of the second connection rod, and the deflector being not directly connected to the first connection rod.

12. The air deflection mechanism according to claim 11, wherein:

the driver mechanism is one of two driver mechanisms of the air deflection mechanism; and two ends of the deflector in a length direction of the deflector are connected to the second connection rods of the two driver mechanisms, respectively.

13. The air deflection mechanism according to claim 11, wherein:

a surface of the deflector facing towards the air outlet includes a first surface and a second surface in a width direction of the deflector;

an edge of the first surface is connected to an edge of the second surface;

another edge of each of the first surface and the second surface extends towards a surface of the deflector facing away from the air outlet; and a connection between the second connection rod and the deflector is coincident with a connecting line between the first surface and the second surface.

14. An air conditioner comprising:

a housing, an air outlet being formed at the housing, and an air outlet channel being formed in the housing and in communication with the air outlet; and an air deflection mechanism including:

a driver mechanism including:

a first connection rod movably disposed in the housing in an extending direction of the air outlet channel;

a first driver assembly disposed at the housing, the first driver assembly being connected to the first connection rod to drive the first connection rod to move;

a second connection rod, a first end of the second connection rod being rotatably connected to an end of the first connection rod close to the air outlet and a second end of the second connection rod extending towards the air outlet; and a second driver assembly disposed at the housing, the second driver assembly being connected to the second connection rod to drive the second connection rod to rotate relative to the first connection rod, and the second driver assembly being slidable relative to the second connection rod; and a deflector directly fixedly connected to the second end of the second connection rod, and the deflector being not directly connected to the first connection rod.

15. The air conditioner according to claim 14, wherein:

a rack is provided at the first connection rod and extends in a length direction of the first connection rod; and the first driver assembly includes:

a drive motor disposed at the housing; and a gear connected to an output shaft of the drive motor and engaged with the rack.

16. The air conditioner according to claim 14, wherein:

a slide groove is formed at the second connection rod and extends in a length direction of the second connection rod; and the second driver assembly includes:

a drive motor disposed at the housing;

a gear connected to an output shaft of the drive motor; and a third connection rod movably disposed at the housing, a second rack being disposed on the third connection rod, the second rack extending in a length direction of the third connection rod and being engaged with the second gear, and a slider being disposed at the third connection rod and slidably arranged in the slide groove.

17. The air conditioner according to claim 16, wherein the third connection rod extends along a straight line or an arc line.

18. The air conditioner according to claim 16, wherein:

the driver mechanism further includes a drive box disposed at the housing;

the first connection rod, the first driver assembly, and the second driver assembly are disposed at the drive box;

the first connection rod and the third connection rod are movably disposed in the drive box;

the second end of the second connection rod extends out of the drive box;

at least two first guide posts are disposed at the first connection rod and spaced apart from each other in a length direction of the first connection rod;

a first guide groove is formed at the drive box and engaged with the at least two first guide posts;

at least two second guide posts are disposed at the third connection rod and spaced apart from each other in the length direction of the third connection rod; and a second guide groove is formed at the drive box and engaged with the at least two second guide posts.

19. The air conditioner according to claim 18, wherein:

a guide wheel is rotatably disposed in the drive box, an engagement groove being formed at a circumferential wall of the guide wheel and extending in a circumferential direction of the guide wheel;

a guide channel is formed at the first connection rod and extends in the length direction of the first connection rod; and the first connection rod is engaged in the engagement groove at each of two opposite side edges of the guide channel.

20. The driver mechanism according to claim 1, wherein:

a slide groove is formed at the second connection rod and extends in a length direction of the second connection rod; and the second driver assembly includes:

a drive motor disposed at the housing;

a gear connected to an output shaft of the drive motor; and a third connection rod movably disposed at the housing, a second rack being disposed on the third connection rod, the second rack extending in a length direction of the third connection rod and being engaged with the second gear, a slider being disposed at the third connection rod and slidably arranged in the slide groove, and the third connection rod being a curved rod with an arc protruding towards the air outlet.

* * * * *